US006962037B2

(12) United States Patent
Borchard

(10) Patent No.: US 6,962,037 B2
(45) Date of Patent: Nov. 8, 2005

(54) METHODS FOR SEALING A LOAD PLACED ON A PALLET

(76) Inventor: James A. Borchard, 600 Beacon Pl., Oxnard, CA (US) 93033

( * ) Notice: Subject to any disclaimer, the term of this patent is extended or adjusted under 35 U.S.C. 154(b) by 0 days.

(21) Appl. No.: 10/115,270

(22) Filed: Apr. 2, 2002

(65) Prior Publication Data

US 2002/0170270 A1 Nov. 21, 2002

Related U.S. Application Data

(60) Provisional application No. 60/367,352, filed on Apr. 3, 2001.

(51) Int. Cl.[7] ..... B65B 31/00
(52) U.S. Cl. ..... 53/434; 53/403; 53/469
(58) Field of Search ..... 53/512, 567, 284.7, 53/79, 432, 403, 405, 434, 447, 477, 479, 469

(56) References Cited

U.S. PATENT DOCUMENTS 3,788,462 A * 1/1974 Meincer ..... 206/595
4,055,931 A * 11/1977 Myers ..... 53/408
4,562,689 A * 1/1986 Hannen ..... 53/434
5,207,727 A * 5/1993 Pearce et al. ..... 414/792.7
5,421,138 A * 6/1995 Muise et al. ..... 53/440
5,502,947 A * 4/1996 Birkenfeld et al. ..... 53/442
5,701,722 A * 12/1997 Franklin et al. ..... 53/399
5,950,402 A * 9/1999 Hoddinott ..... 53/432
6,050,419 A * 4/2000 Flanagan et al. ..... 206/597
2003/0182900 A1 * 10/2003 Bowden et al. ..... 53/432

* cited by examiner

*Primary Examiner*—John Paradiso
(74) *Attorney, Agent, or Firm*—Eric K. Satermo

(57) ABSTRACT

A system for sealing a load with film, where the load is placed on a pallet, includes a frame and a vertically moveable platform on which the pallet is received. A clamp is mounted to the frame and is configured to engage the load independently of the pallet when the pallet is received on the platform. A rack is mounted to the frame so as to be vertically movable, and a pair of cross members are mounted to the rack so as to be horizontally movable. An engagement subsystem configured to engage sides of the film and a sealing subsystem configured to seal the film are mounted to the cross members. In operation, when the pallet is placed on the platform, the sides of the film, which in the form of a sleeve where the sides define an inner space when separated, are engaged with the engagement subsystem when the rack is in the upper position. Thereafter, the cross members move outwardly to separate the sides of film and to define the inner space. The rack is then moved to the lower position, thereby enveloping the load within the sleeve of the film. The load is then secured with the clamp and separated from the pallet. The cross members are then moved inwardly so that the sides of the film are brought together, which are then sealed with the sealing subsystem, for example, with heat. The sides of the film are disengaged, and the cross members are moved outwardly. The load may then be replaced on the pallet with the seal positioned therebetween. The film may then be sealed and cut at the top of the load, thereby forming a bag around the load.

24 Claims, 23 Drawing Sheets

| FILM RACK POSITIONS: | DISTANCE |
|---|---|
| X START POSITION | 0 |
| Y LOW POSITION | -10 |
| Z INTERMEDIATE POSITION | -2 |

| | | | | 90 | | | | | 174 | 169 | 208 | 206 |
|---|---|---|---|---|---|---|---|---|---|---|---|---|
| | | | | FILM SUBSYSTEM | | | | | | | | |
| STEP | FUNCTION | TIME (sec) | EXTRA TIME | VACUUM SYSTEM | INJECTION NOZZLES POSITION | AIR | VACUUM | GAS | HEAT SEAL BAR | CUT-OFF KNIFE | SIDE AIR NOZZLE | CENTER AIR NOZZLE |
| 1 | CROSS MEMBERS CLOSE | t=0 | DURING | ON | | | | | | | | |
| 2 | CROSS MEMBERS OPEN | 3 | DURING | ON | IN | ON | | | | | | |
| 3 | RACK DOWN TO Y | 6 | DURING | ON | IN | ON | | | | | | |
| 4 | CLAMP CLOSES | 2 | DURING | OFF | IN | OFF | | | | | | |
| 5 | PLATFORM DOWN | 3 | DURING | | IN | | | | | | ON | |
| 6 | CROSS MEMBERS CLOSE | 3 | 20 | | IN | | ON | | | | | |
| 6.1 | | | | | | | OFF | | | | | |
| 6.2 | INJECT GAS (IF DESIRED) | | | | | | | ON | | | | |
| 6.3 | | | | | | | | OFF | | | | |
| 6.4 | | | | | OUT | | | | | | | |
| 6.5 | SEAL FILM | | | | | | | | ACTIVE | | | |
| 6.6 | | | | | | | | | | | OFF | |
| 7 | CROSS MEMBERS OPEN | 3 | DURING | | | | | | | | | ON |
| 8 | PLATFORM UP | 3 | DURING | | | | | | | | | ON/OFF |
| 9 | CLAMP OPENS | 1 | | | | | | | | | | |
| 10 | RACK UP TO Z | 5 | | | | | | | | | | |
| 11 | CROSS MEMBERS CLOSE | 3 | 7 | | | | | | | | ON | |
| 11.1 | CUT/SEAL FILM AT TOP | | | | | | | | ACTIVE | ACTIVE | | |
| 11.2 | | | | | | | | | | | OFF | |
| 12 | CROSS MEMBERS OPEN | 3 | | | | | | | | | | |
| 13 | RACK UP TO X | 2 | | | | | | | | | | |
| 14 | RETURN TO STEP 1 | 3 | | | | | | | | | | |

FIG. 18

METHODS FOR SEALING A LOAD PLACED ON A PALLET

CROSS REFERENCE TO RELATED APPLICATIONS

The present invention claims priority on U.S. Nonprovisional utility patent application Ser. No. 09/826,384 and U.S. Provisional Application for Patent Ser. No. 60/367,352, filed Apr. 3, 2001.

BACKGROUND OF THE INVENTION

1. Field of the Invention

The present invention relates to the handling of loads placed on pallets. More particularly, the present invention relates to apparatus for sealing a load, such as cartons of goods or produce, placed on a pallet. One useful application of the present invention is the sealing and preservation of produce such as fruits and vegetables within an artificial environment for shipping and storage, where the produce is packed in cartons which are, in turn, stacked on pallets for shipping.

2. Description of the Related Art

The movement of produce from the field or orchard to the marketplace is a primary concern for farmers and merchants. To ensure freshness for the consumer, produce needs to be harvested, packed, transported, unloaded, and, finally, displayed for sale. Depending upon the location of the marketplace, this process may also require storing the produce for periods of time while awaiting transportation, unloading, or displaying. The storage may take place in a refrigerated warehouse or storeroom. If the marketplace is distant from the field or orchard, then the transportation itself of the produce requires a relatively long period of time. Indeed, for foreign markets, it may be several weeks between harvest by a farmer and end purchase by a consumer.

It is during these periods of storage and transportation that are of primary concern for farmers and merchants. If not handled properly, produce will spoil, and profits will sag. Accordingly, time, money, and energy are dedicated to improving the packing and the preservation of produce to maximize the quality of produce for market.

When harvested, produce is typically placed in cartons which, in turn, are stacked on pallets. This may take place in the field or orchard or in a nearby warehouse. When palletized, the cartons of produce may then be easily moved by forklift to refrigerated tractor-trailer rigs and, if needed, to refrigerated containers for loading onto trains and ships.

To enhance the preservation of produce when on a pallet, an oxygen-depleted artificial atmosphere may be created by wrapping either individual cartons of produce or an entire stack of cartons of produce in plastic film. Oxygen levels within the wrapped carton or stack of cartons may then be minimized, for example, by injecting nitrogen into or by evacuating gas from within the wrapped stack of cartons.

One example of a conventional approach to preserving produce is disclosed in U.S. Pat. No. 5,945,147 entitled "Method for Packaging Fresh Perishable Food" by James A. Borchard (who is also the inventor in the present application), the entire disclosure of which is incorporated herein by reference.

Other conventional approaches entail covering a stack of cartons on a pallet with a bag and then sealing bottom edges of the bag to create a substantially hermetic environment. Conventional systems perform this bagging process in assembly-line fashion using a conveyor. Pallets of produce are moved on the conveyor through successive stages of placing a bag over a stack of cartons, sealing the opening of the bag with adhesive tape, and applying gas to preserve the produce within the bag. Each stage requires manual labor, thereby increasing cost. In addition, the bagging process is carried out in a refrigerated warehouse in which costs are directly proportional to the amount of floor space required for the preservation operation.

In addition to preservation, cartons of produce may also require fumigation. Conventional approaches to fumigating cartons of produce entail moving pallets of produce into large chambers, fumigating the chamber, and then removing the pallets from the chamber. Once again, large warehouse space and substantial manual labor are required.

In view of the foregoing, there remains a need in the art for systems and methodology that seal and, if desired, preserve a load, for example, a stack of cartons containing produce, placed on a pallet in an efficient and cost-effective manner.

BRIEF SUMMARY OF THE INVENTION

In view of the foregoing, the present invention presents technology in the form of apparatus, associated operative methodology, and general methodology that enables a load placed on a pallet to be sealed. In many preferred embodiments, particularly involving fresh produce, the methods and apparatus of the present invention are particularly beneficial in that produced packed in cartons that are stacked on a pallet may be sealed in the field and readied for shipping and/or storage. The present invention eliminates the need for large warehouses and manual labor.

According to a preferred embodiment, a system for sealing a load with film, where the load is placed on a pallet, includes a frame and a vertically moveable platform on which the pallet is received. A clamp is mounted to the frame and is configured to engage sides of the load when the pallet is received on the platform. A rack is mounted to the frame such that the rack is vertically movable between an upper position in which the rack is above a top of the load and a lower position in which the rack is below a bottom of the load. A pair of cross members are mounted to the rack such that the cross members are horizontally movable. The system also includes engagement subsystem and sealing subsystem mounted to the cross members. The engagement subsystem is configured to engage sides of the film, and the sealing subsystem is configured to seal the sides of the film together.

In operation, when the pallet is placed on the platform, the sides of the film, which in the form of a sleeve where the sides define an inner space when separated, are engaged with the engagement subsystem when the rack is in the upper position, for example, with vacuum ports. Thereafter, the cross members move outwardly to separate the sides of film and to define the inner space. The rack is then moved to the lower position, thereby enveloping the load within the sleeve of the film. The load is then secured with the clamp and separated from the pallet. The cross members are then moved inwardly so that the sides of the film are brought together, which are then sealed with the sealing subsystem, for example, with heat. The sides of the film are disengaged, and the cross members are moved outwardly. The load may then be replaced on the pallet with the seal positioned therebetween. In a preferred embodiment, the film is then sealed and cut at the top of the load, thereby forming a bag around the load.

According to a preferred embodiment, the entire sealing process between initially placing the unsealed load and pallet on the platform and removed the sealed load and pallet from the platform, is substantially automated. Accordingly, a control unit may be provided along with a power supply to control and actuate each of the subsystems of the overall sealing system. Accordingly, substantial manual labor is reduced and uniformly sealed loads are provided.

According to preferred methodology of the invention, a method for sealing a load placed on a pallet includes first enveloping the load within film and then securing the load independently of the pallet. The load may then be separated from the pallet, and a seal may be formed in the film under the bottom of the load. In a preferred embodiment, the seal is in the form of a flap that is sandwiched between the bottom of the load and the pallet without any buckling so that the sealed load rests with stability on the pallet.

According to further preferred embodiments, particularly those involving fresh produce, the sealing system of the present invention may also include subsystems for evacuating the load when enveloped by the film to remove oxygen and subsystem for fumigating the load. Accordingly, a preferred artificial atmosphere may be created within the sealed film for the load, thereby retarding the ripening process of the produced and enhancing freshness during shipping and storage.

Other features and advantages of the present invention will become apparent to those skilled in the art from a consideration of the following detailed description taken in conjunction with the accompanying drawings.

BRIEF DESCRIPTION OF THE SEVERAL VIEWS OF THE DRAWINGS

FIG. 18 is a table illustrating steps in a preferred embodiment for sealing a load on a pallet in accordance with the invention;

DETAILED DESCRIPTION OF THE INVENTION

Figure 1:
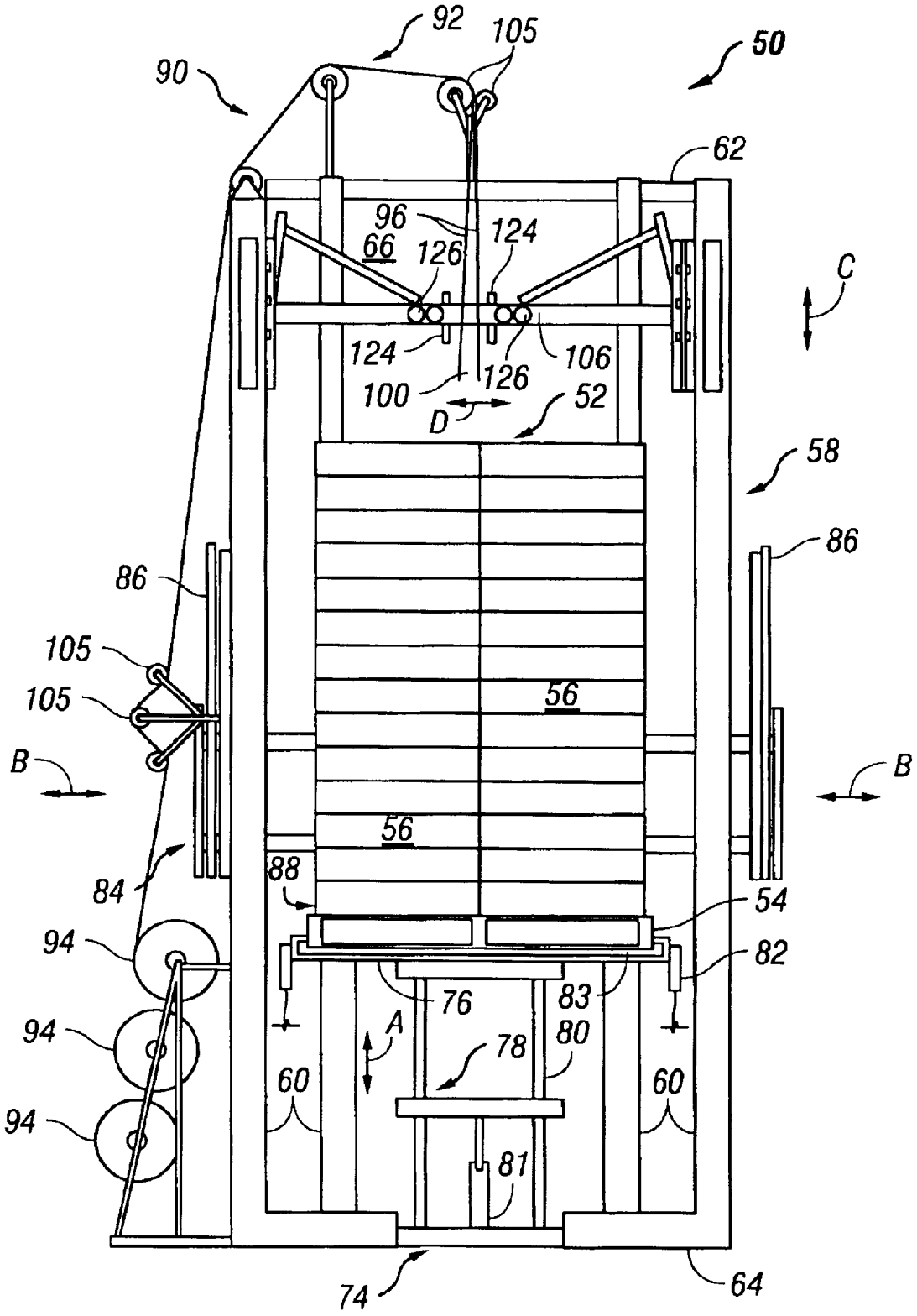
FIG. 1 is a front plan view of an exemplary system for sealing a load placed on a pallet configured in accordance with the present invention.
Figure 2:
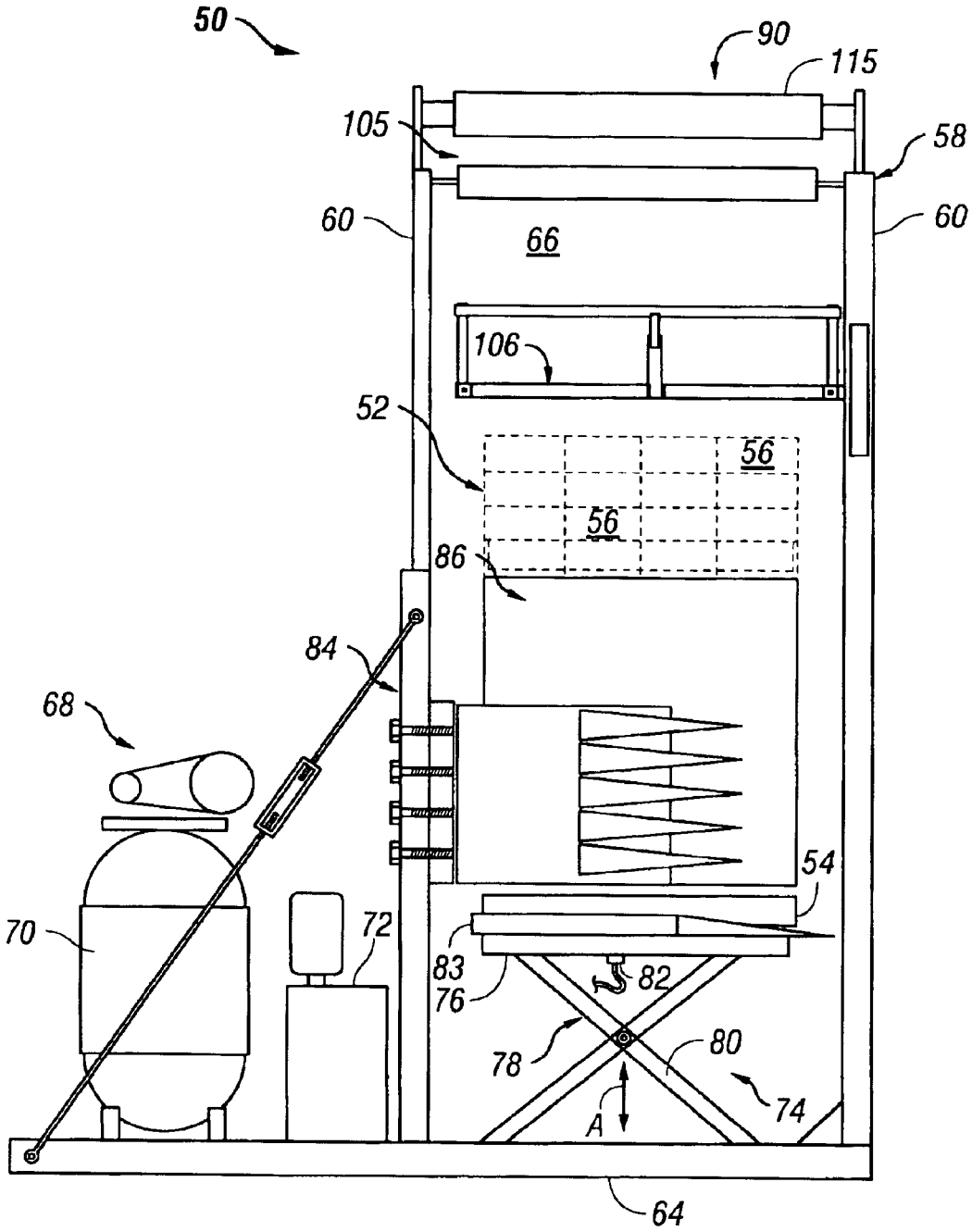
FIG. 2 is a side plan view of the sealing system of FIG. 1.

Referring more particularly to the drawings, an exemplary sealing system 50 for sealing a load 52 placed on a pallet 54 and configured in accordance with the teachings of the present invention is illustrated in FIGS. 1 and 2. For purposes of explanation and without limiting the scope of the present invention, exemplary system 50 is illustrated and described herein as a system for sealing and preserving a load 52 of produce such as fruits or vegetables packed in a plurality of cartons 56, which cartons are stacked on the pallet 54. However, those skilled in the art will appreciate that the principles of the present invention are equally applicable to any load which is receivable on a pallet for storage or transportation.

The present invention provides not only apparatus for sealing a load placed on a pallet but also methodology associated with utilizing the apparatus of the invention, as well as general methodology for sealing a load placed on a pallet. The description the apparatus of the invention follows hereafter, with the operational methodology being described thereafter.

Apparatus

Exemplary sealing system 50 generally includes a frame 58 with a plurality of vertical members 60 connected between a top 62 and a base 64, thereby defining an inside 66 of the frame. The sealing system 50 may also include a dedicated power supply 68 (shown in FIG. 2), which is preferably disposed on the base 64. The power supply 68 may include any number of devices and systems necessary for providing power to the elements of the invention described below, for example, a compressor 70, an electrical supply 72 such as a generator or a motor, hydraulics, and so on. In a preferred embodiment, the frame 58 is configured so that the entire system 50 is portable so that the system can be implemented in any desired location. This portable feature of the invention is particularly beneficial in fresh produce embodiments in which the sealing system 50 may be temporarily installed in a produce field or orchard.

A base subsystem 74 including a platform 76 may be disposed within the frame 58. The load-carrying pallet 54 is receivable on the platform 76. Preferably, the platform 76 is mounted to a vertically movable substructure 78 connected to the power supply 68 such that the platform 68 may be raised and lowered as shown by arrow A in the drawings. Exemplary substructure 78 may be configured in any manner that enables vertical movement of the platform 68, for example, as a scissors-like structure 80 connected to a hydraulic lift 81. In certain implementations, it may be preferably to include one or more injection nozzles 82 disposed on sides 83 of the platform 76, which will be discussed in more detail below.

A clamping subsystem 84 including a pair of plates 86 is mounted to the frame 58 and is connected to the power supply 68. Exemplary clamping subsystem 84 is configured so that the plates 86 are movable horizontally as shown by arrows B in FIG. 1, for example, under power of the motor 72. Exemplary plates 86 are vertically disposed and configured so that at least a bottom portion of the load 52 is positioned between the plates 86 when the plates are moved inwardly. In the example shown in the drawings in which the load 52 includes a stack of cartons 56, the plates 86 are configured to clamp at least a bottom layer 88 of cartons 56. In many implementations, the plates 86 may be configured such that a predetermined bottom portion of the load 52 is engaged, for example, about one half of the layers of cartons 56 making up the load. Accordingly, the load 52 may be retained or secured independently of the pallet 54.

Figure 3:
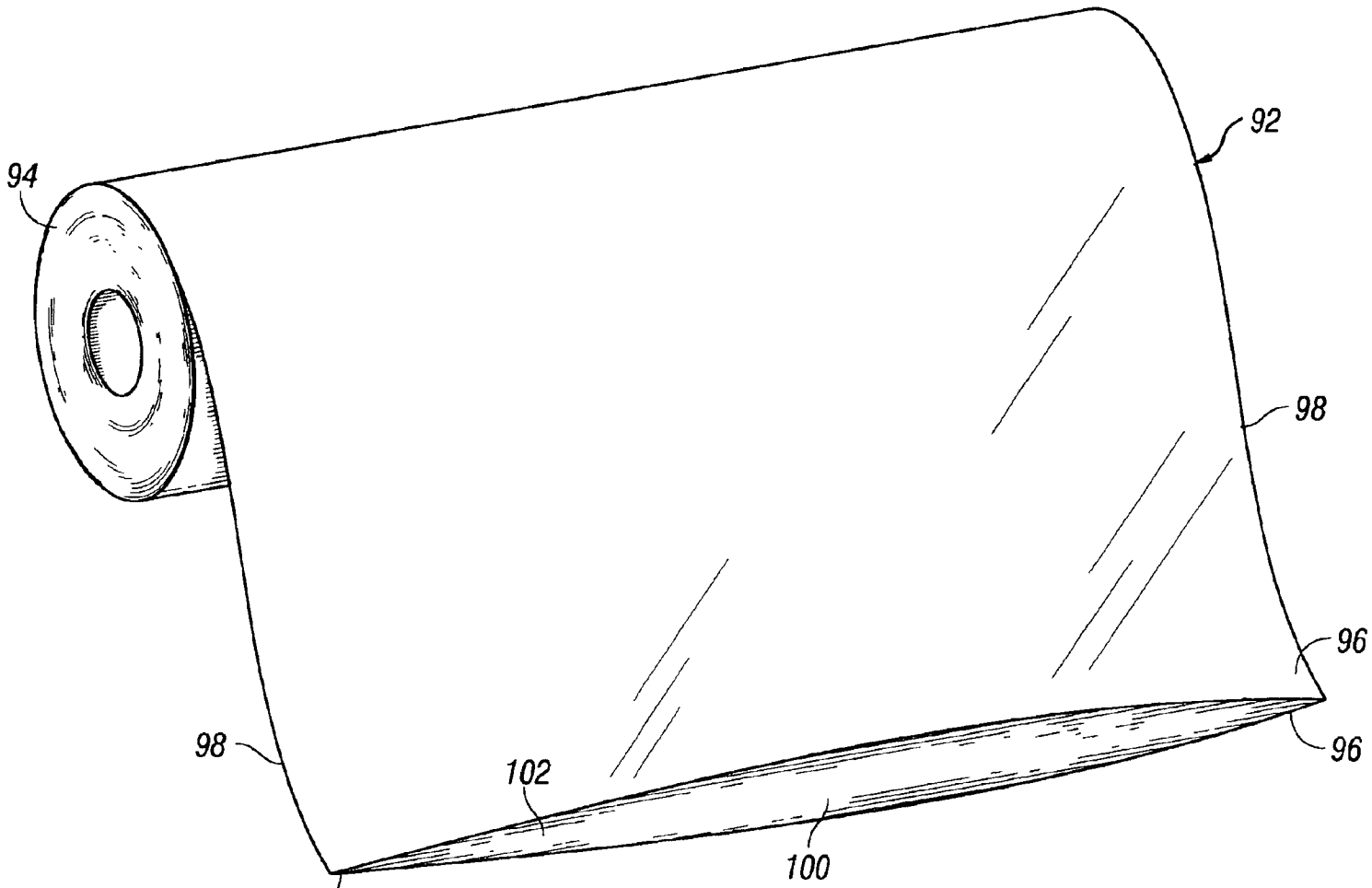
FIG. 3 is a perspective view of the exemplary roll of film utilized by the methods and apparatus of the present invention, particularly illustrating film with sides that define an inner space therebetween.

Exemplary sealing system 50 also includes a film subsystem 90 mounted to the frame 58 and connected to the power supply 68. Although the sealing system 50 of the present invention may be configured to seal loads with any type of film, a sleeve-type film 92 as shown in FIG. 3 is preferable. More specifically, the film 92 is preferably disposed in a roll 94 that is rotatably mounted to the frame 58. The film 92 has sides 96, e.g., two sides, that are integral along longitudinal edges 98 and that define an inner space 100 when separated. An opening 102 is defined at a leading cut edge 104 of the film 92. One of the advantages of employing the film 92 shown in FIG. 3 with the sealing system 50 of the invention is that the film is commercially available and, therefore, relatively inexpensive. The frame 58 may include structure to store additional rolls 94 of film 92 as shown in FIG. 1. In addition, to facilitate the dispensing of the film 92 or 212, a number of rollers 105 may be disposed on the frame 58 so that the film is dispensed from above the load 52.

Figure 4:
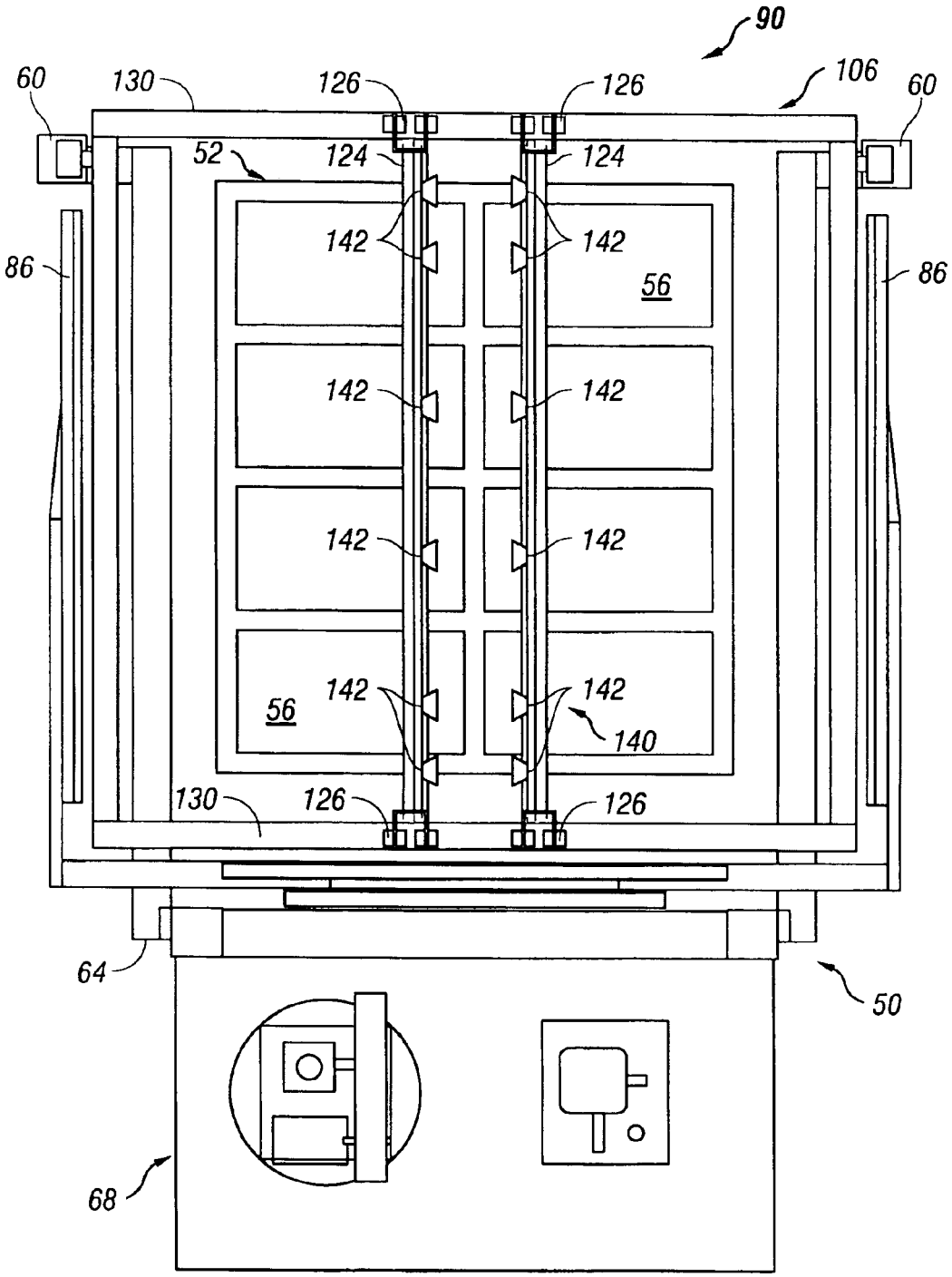
FIG. 4 is a top view of the sealing system the invention, particularly illustrating cross members movably mounted on a rack.
Figure 5:
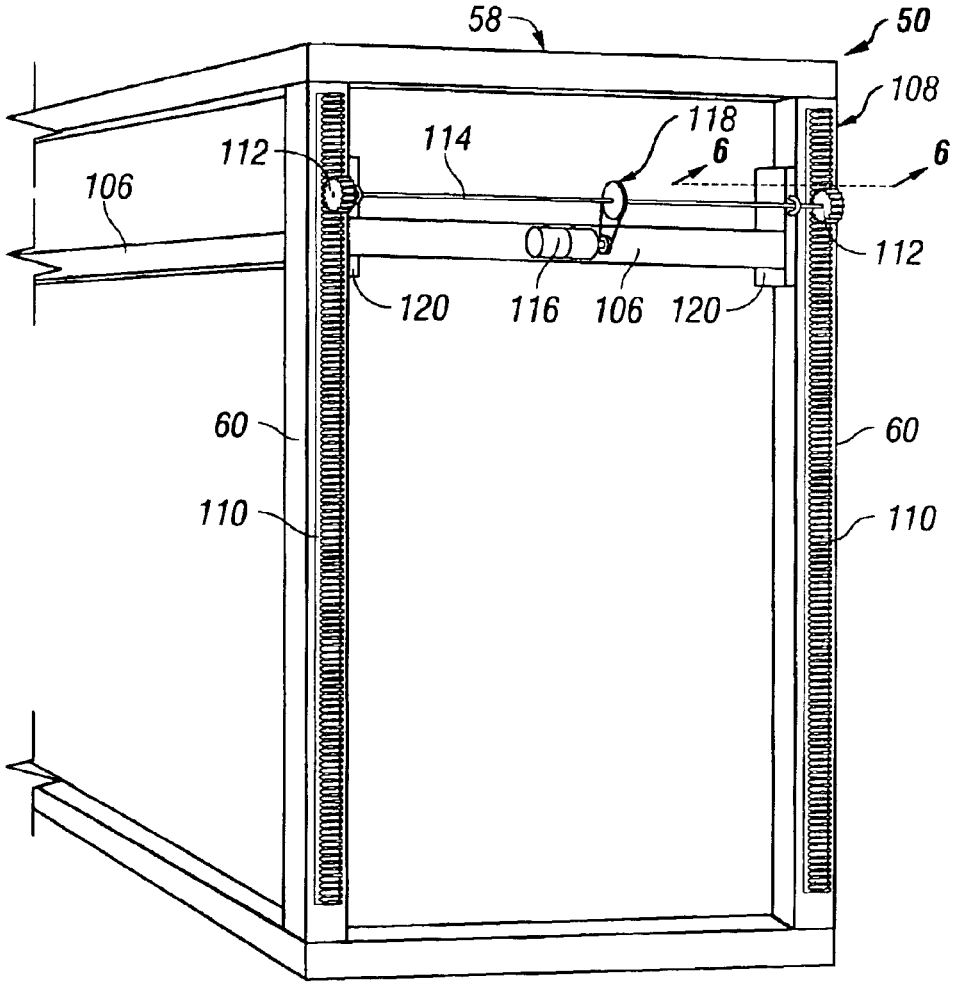
FIG. 5 is a fragmentary perspective view of a propulsion system for a rack mounted on a frame in accordance with an exemplary embodiment of the invention.

With additional reference to FIG. 4, exemplary film subsystem 90 may include a film rack 106 that is mounted to the frame 58 so that the film rack is movable vertically as shown by arrow C in FIG. 1. Although any type of propulsion system may be used, according to a preferred embodiment, exemplary film subsystem 90 may include a rack-and-pinion propulsion subsystem 108 configured to raise and lower the film rack 106, as shown in FIG. 5.

Figure 6:
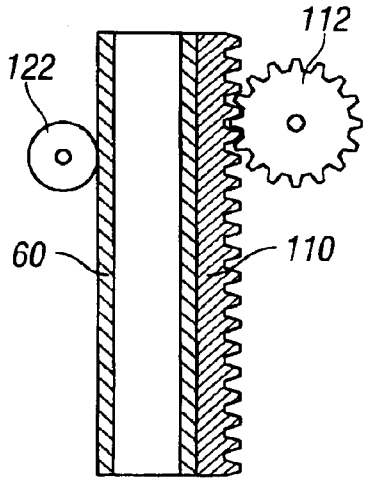
FIG. 6 is a fragmentary cross-sectional view of the propulsion system taken along line 6—6 of FIG. 5.

For example, exemplary propulsion subsystem 108 may include a pair of gear racks 110 respectively mounted to a pair of the vertical members 60 of the frame 58 and a pair of pinions 112 mounted on opposing ends of an axle 114. A motor 116 may drive the axle 114 with, for example, a drive train 118. A pair of braces 120 may be provided to support the axle 114 at or near the pinions 112, respectively. Referencing FIG. 6, additional support may be provided by a pair of counter wheels 122 (only one is shown) respectively and rotatably mounted to the braces 120. The counter wheels 122 roll along a side of a respective vertical member 60 that is opposite to the side of the vertical member to which the gear rack 110 is mounted. Those skilled in the art will appreciate that many alternative embodiments of the propulsion subsystem 108 are possible, one alternative of which will be described below.

With further reference to FIGS. 1, 2, and 4, exemplary film subsystem 90 may also include a pair of cross members 124 that are movably mounted to the film rack 106 with, for example, wheels 126. Accordingly, the cross members 124 are horizontally movable with respect to the load 52 as shown by arrow D in FIG. 1 and provide support for a number of preferred subsystems of the invention, which will be discussed in more detail below.

Figure 7:
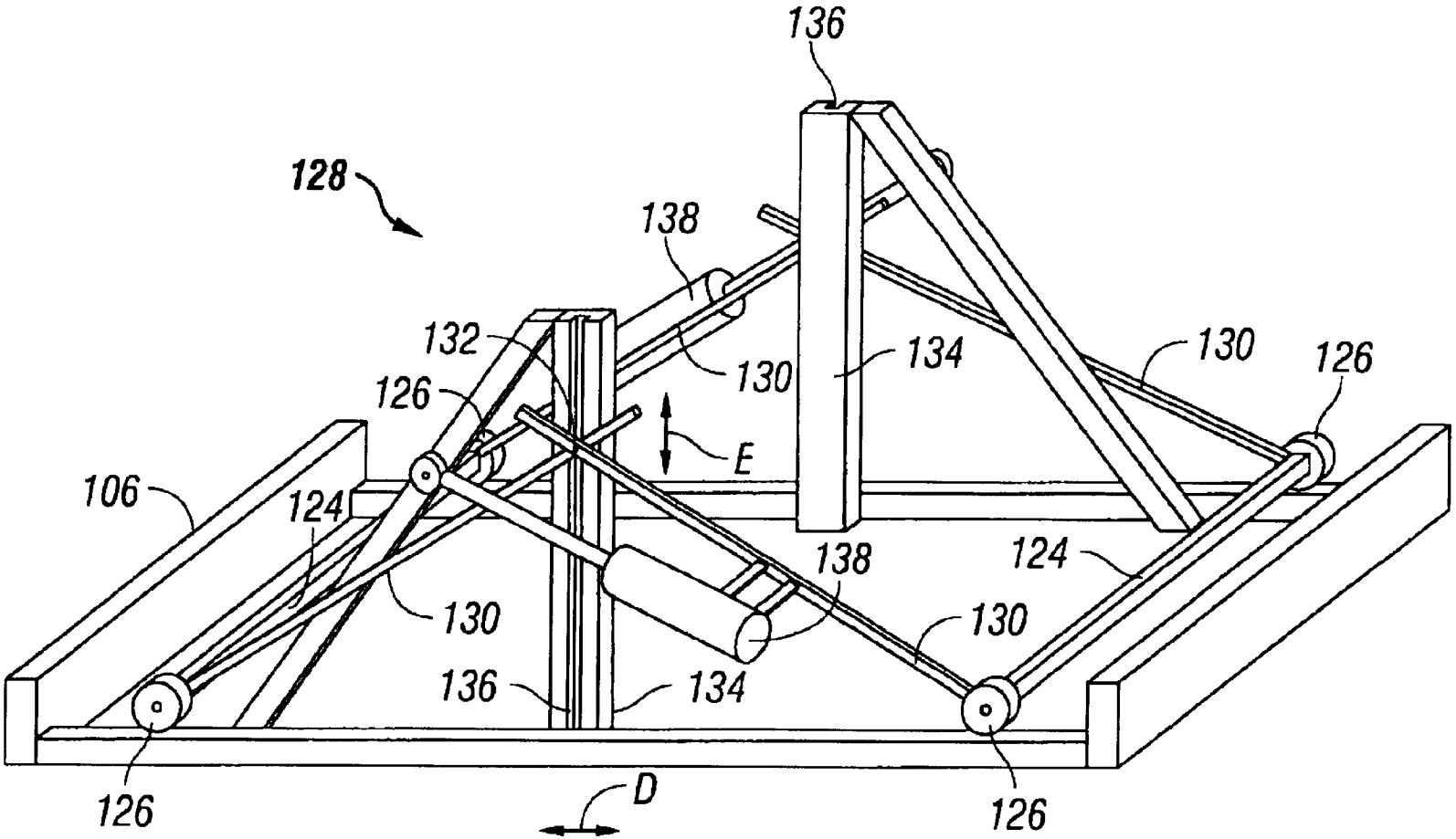
FIG. 7 is a perspective view of an exemplary embodiment of a rack and cross member system of the present invention.

Those skilled in the art will appreciate that there may be any number of ways to propel the cross members 124 inwardly and outwardly with respect to each other. For example, with additional reference to FIG. 7, a cross-member propulsion subsystem 128 may include two pairs of arms 130, with each respective pair of arms being pivotally connected between the cross members 124 at or near the wheels 126 and pivotally connected to each other at a pin 132. In addition, exemplary subsystem 128 may include a pair of supports 134 each with a vertically disposed slot 136 for respectively and slidingly receiving one of the pins 132. A pair of hydraulic lifts 138 may be respectively and pivotally connected between the supports 134 and one of the arms 130. Accordingly, when actuated, the lifts 138 contact and expand as desired, thereby drawing together and expanding, respectively, the arms 130, with the pins 132 sliding upwardly and downwardly in the slots 136 as shown by arrow E in FIG. 7. In response to such action by exemplary propulsion subsystem 128, the cross members 124 move inwardly and outwardly as shown by arrow D in FIG. 7.

One of the systems supported by the cross members 124 may be a system or means for engaging the sides 96 of the film 92. More specifically, the film subsystem 90 preferably includes a system that engages the sides 96 of the film 92 so that the sides 96 can be separated to provide access to the inner space 100 through the opening 102. For example, with additional reference to FIG. 8, a vacuum subsystem 140 may be mounted to the cross members 124 and configured to engage the sides 96 of the film 92. Exemplary vacuum subsystem 140 may include a plurality of vacuum ports 142 mounted along each of the cross members 124. With additional reference to FIG. 9, each of the vacuum ports 142 is in communication with a vacuum source 144 so that when actuated by a control unit 146, the ports 142 draw air as shown by arrows F in FIG. 8. The operation of the vacuum subsystem 140 will be described in detail below.

Figure 8:
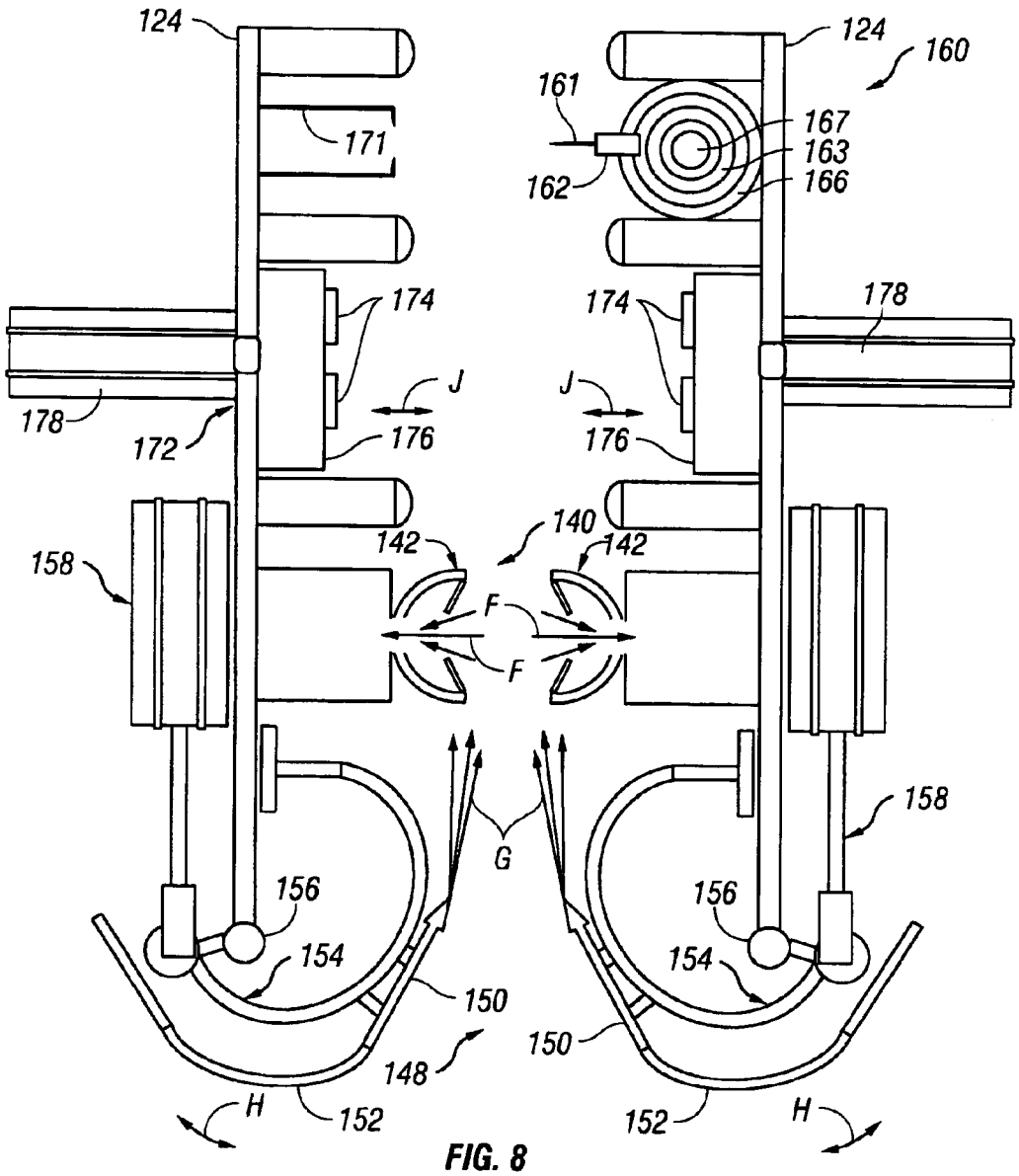
FIG. 8 is a schematic view of a sealing subsystem configured according to an exemplary embodiment of the invention.
Figure 9:
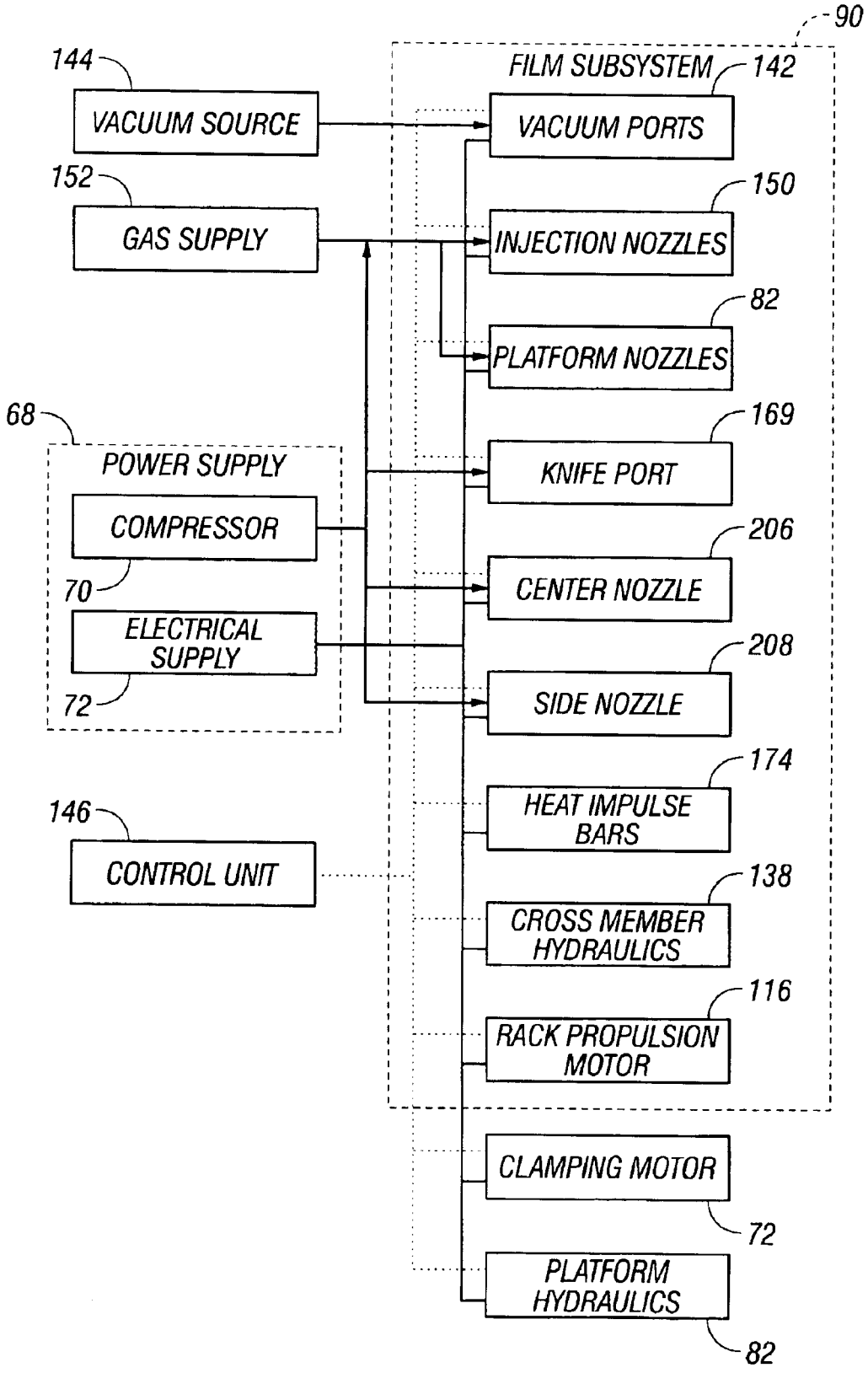
FIG. 9 is a block diagram of a sealing system according to a preferred embodiment of the invention.

Exemplary film subsystem 90 may also include an injection subsystem 148 including one or more injection nozzles 150 mounted to the cross members 124, preferably at locations below that of the vacuum ports 142 as shown in FIG. 8. Each of the injection nozzles 150 may be in communication with a source of compressed air such as the compressor 70 so that air may be injected as shown by arrows G. In addition, one or more of the injection nozzles 150 may be connected to a gas supply 152 as shown in FIG. 9 so that gas, for example, for preservation or fumigation purposes, may be ejected.

In certain implementations, it may be preferable to pivotally mount the nozzles 150 to the cross members 124, for example, on a linkage 154 attached to the cross member 124 at a pivot 156. Each linkage 154 may be connected to a power source such as a dual-acting cylinder 158. Accordingly, when actuated, the dual-acting cylinders 158 pivot the linkages 154 as shown by arrows H. The operation of the injection subsystem 148 will be described in more detail below.

Figure 10:
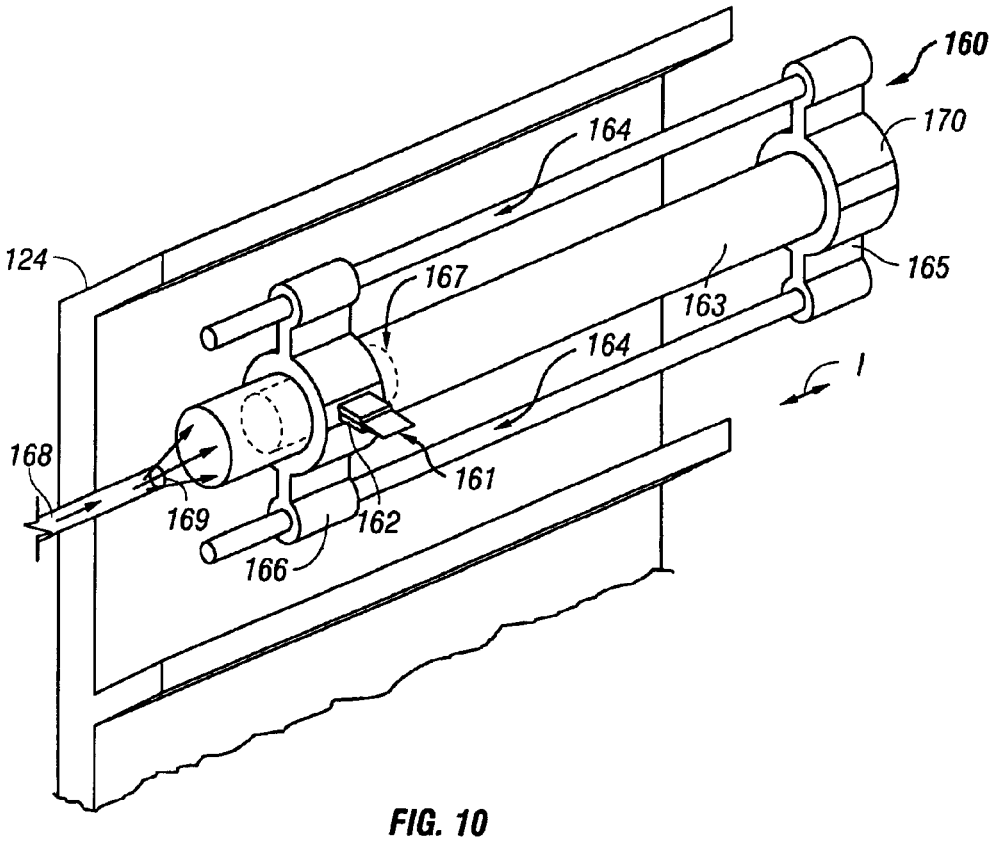
FIG. 10 is a fragmentary perspective view of a cutting and a sealing subsystem configured in accordance with an exemplary embodiment of the present invention.

Referencing particularly FIGS. 8 and 10, the film subsystem 90 of the present invention may also include a system or means for cutting the film 92 at a desired location. More specifically, a cutting subsystem 160 may be mounted to the cross members 124 for cutting the film 92. Exemplary cutting subsystem 160 may include a knife 161 mounted on a block 162, preferably releasably mounted to enable replacement of the knife as desired. Exemplary cutting subsystem 160 may also include a cylinder 163 disposed between a pair of braces 164 and mounted along with the braces 164 between a pair of end brackets 165 (only one of which is shown). A collar 166 is slidably mounted on the cylinder 163 and the braces 164, with the block 162 mounted to the collar 166.

Figure 11:
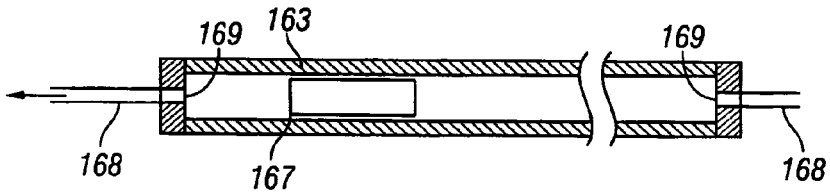
FIG. 11 is a fragmentary cross-sectional view of an exemplary propulsion subsystem for the cutting subsystem of FIG. 10.

The cutting subsystem 160 may include means for propelling the knife 161, for example, such as a magnet 167 slidably disposed within the cylinder 163 and a pneumatic source 168 with a knife port 169 disposed at one end of the cylinder 163. A bumper 170 may be disposed at the other end of the cylinder 163. Alternatively, as shown in FIG. 11, a nozzle 169 may be disposed at each end of the cylinder 163. The pneumatic source 168 may be in communication with the compressor 70 or, alternatively, may be the compressor itself as shown in FIG. 9.

Figure 12:
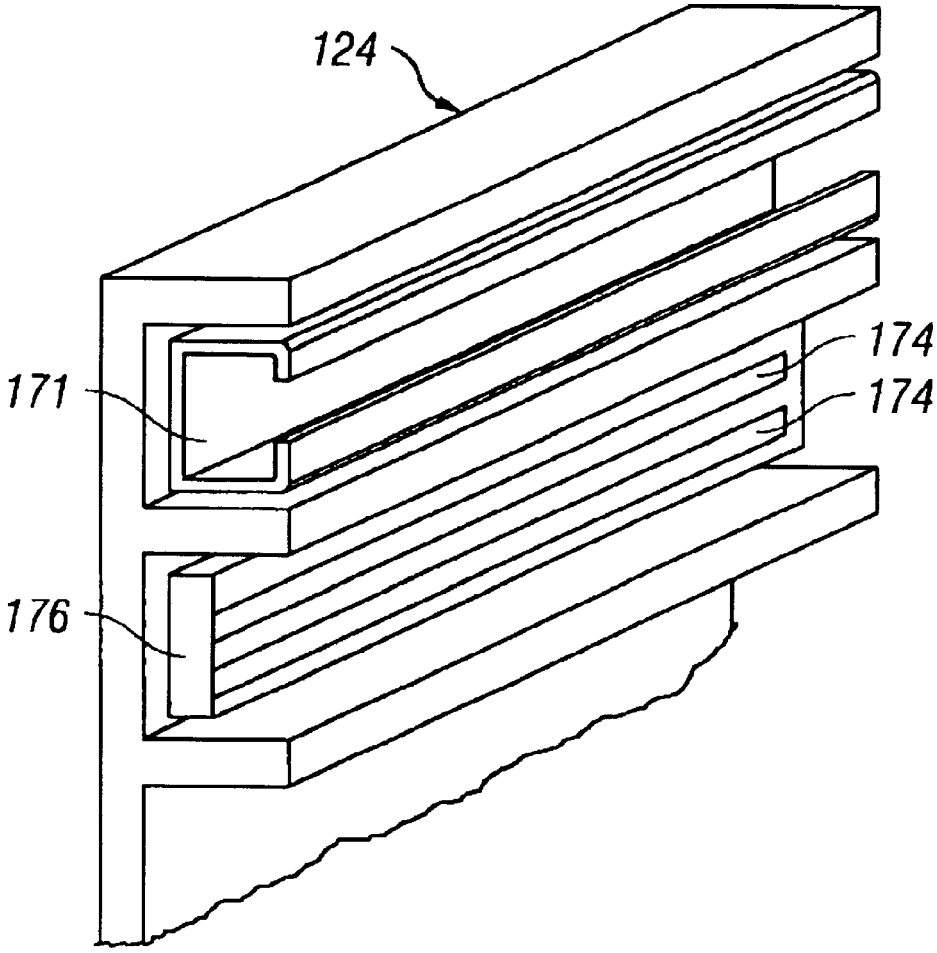
FIG. 12 is a fragmentary perspective view of a cross member on which components of a cutting subsystem and a sealing subsystem are disposed according to exemplary embodiments of each.

Accordingly, when activated, pressurized air is injected from the port 169, thereby pushing the magnet 167 toward the other end of the cylinder 163. Through magnetic attraction, the magnet 167 pulls the collar 166 and the knife 161 to the other end of the cylinder 163 as shown by arrow I. In accordance with this exemplary embodiment, the collar 166 may be configured to have ferrous properties to enable attraction with the magnet 167. As shown in FIG. 12, a channel 171 may be mounted on the cross member 124 opposite that on which the cutting subsystem 160 is mounted for receiving the knife 161 when cutting the film 92. Those skilled in the art will appreciate that the cutting subsystem 160 may be configured in any manner that enables cutting of the film. For example, the film 92 may have transverse perforations are predetermined intervals that enable detachment.

According to the present invention, exemplary film subsystem 90 may also include a system or means for sealing the sides 96 of the film 92 together, for example, at or near the opening 102. More specifically, referencing FIGS. 8 and 12, a sealing subsystem 172 may be mounted to the cross members 124 and configured to fix the sides 96 of the film 92 together to form a seal. For example, the sealing subsystem 172 may include one or more heat impulse bars 174 disposed along the cross members 124, one set of which is shown in FIG. 9. As shown in FIG. 8, two sets of two heat impulse bars 174 are respectively disposed on a base 176 connected to a respective pneumatic cylinder 178. Accordingly, when actuated, the cylinders 178 move the bases 176 toward each other as shown by arrows J, thereby pressing the film 92 between the heat impulse bars 174 which, when actuated by electric current, heat up and melt the sides 96 of the film 92 together.

Figure 13:
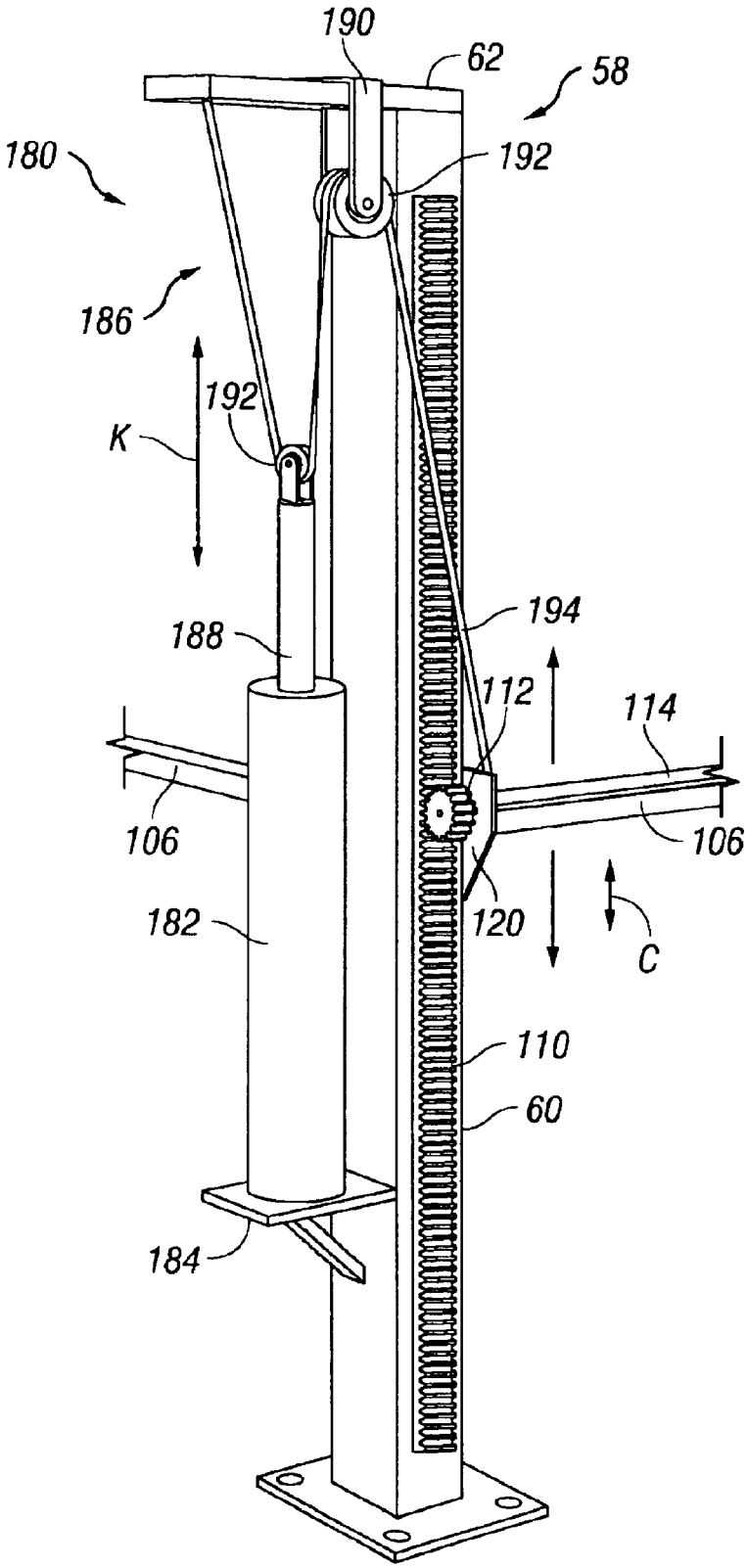
FIG. 13 is a fragmentary perspective view of a propulsion system for a rack mounted on a frame in accordance with another exemplary embodiment of the invention.

Although the foregoing description recites of a specific embodiment of the invention, other embodiments are also contemplated within the broad principles of the invention. For example, an alternative embodiment of an exemplary propulsion subsystem 180 for the rack 106 of the film subsystem 90 is illustrated in FIG. 13. This alternative propulsion subsystem 180 may include a pair of hydraulic cylinders 182 (only one is shown in the drawings) mounted to the frame 58, for example, each with a base 184 attached to a vertical member 60 on which the gear racks 110 are mounted. A pulley system 186 may be employed to link a piston 188 of each cylinder 182 to the brace 120 mounted to the rack 106. The pulley system 186 may include a first pulley 190 mounted to the top 62 of the frame 58 and a second pulley 192 mounted to an end of the piston 188. A flexible member 194 may then be connected between the top 62 of the frame 58 and the brace 120 of the rack 106 via the pulleys 188 and 190. Accordingly, when actuated, the cylinders 182 selectively extend and move the piston 188 outwardly, thereby lowering the rack 106, and contract and move the piston inwardly, thereby raising the rack, as respectively shown by arrows K and C in FIG. 13.

Another example of an alternative embodiment of one of the subsystems described above is illustrated in FIG. 14, specifically, an alternative embodiment of a cross-member propulsion subsystem 196 is shown. Exemplary subsystem 196 may include two pairs of arms 198, with each respective pair of arms pivotally connected between the cross members 124 at or near the wheels 126 and pivotally connected to a respective support 200 mounted to the rack 106 at a pin 202. A pair of hydraulic cylinders 204 may be respectively and pivotally connected between ends of a respective pair of arms 198. Accordingly, when actuated, the cylinders 204 selectively contact and expand, thereby pivoting the arms 198 about the pins 202 as shown by arrows L. In response to such action by exemplary propulsion subsystem 128, the cross members 124 move inwardly and outwardly as shown by arrow D.

Figure 14:
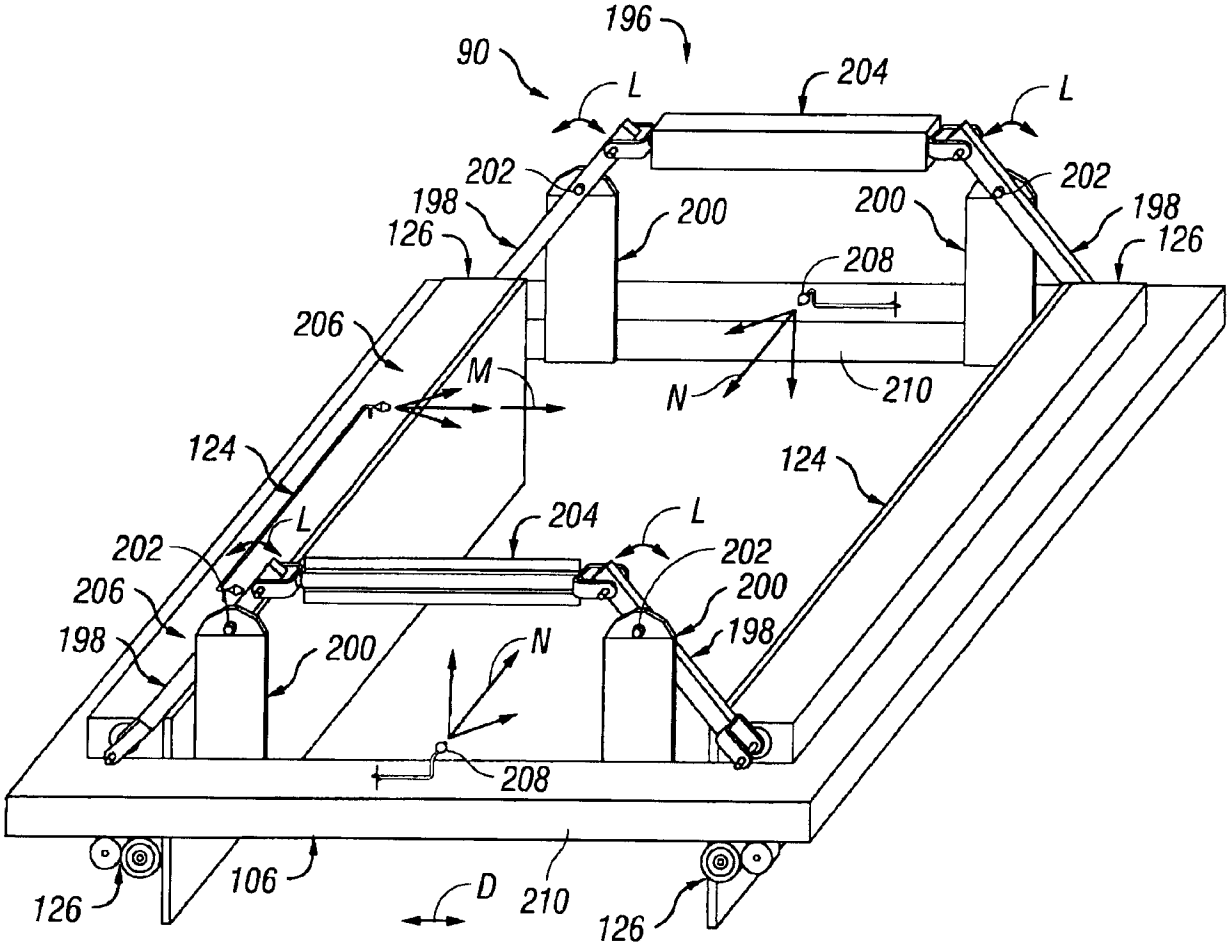
FIG. 14 is a perspective view of a rack and cross member system according to another embodiment of the present invention.

With continued reference to FIG. 14, exemplary sealing subsystem 90 may include additional apparatus for facilitating and improving the operation of the various operations thereof. For example, one or more center nozzles 206 mounted to one of the cross members 124 and in pneumatic communication with the compressor 70 as shown in FIG. 9. Accordingly, when actuated, the center nozzles 206 eject air inwardly toward the opposing cross member as shown by arrow M in FIG. 14. As will be described in detail below, the center nozzles 206 facilitate the formation of a preferred seal of the film 92.

Also illustrated in FIG. 14 is apparatus that is configured to further facilitate the formation of a preferred seal of the film 92, namely, a pair of side nozzles 208 disposed on opposing sides of the rack 106, for example, sides 210. As shown, sides 210 are disposed substantially perpendicular to the cross members 124. The size nozzles 208 are in pneumatic communication with the compressor 70 as shown in FIG. 9 so that when actuated, air is ejected out of the nozzles 208 as shown by arrows N in FIG. 14.

As will be described operationally below, the side nozzles 208 may be particularly useful in implementations utilizing a type of commercially available pleated film 212 shown in FIGS. 15 and 16. Elements of exemplary film 212 that are substantially analogous to those of film 92 shown in FIG. 3 will be indicated with like reference numerals. Exemplary film 212 may be disposed in a roll 94 that is rotatably mountable to the frame 58. The film 212 has a pair of sides 96 disposed between a pair of pleats 214 each having a pair of panels 216 connected along a longitudinal crease 218. An inner space 100 is defined when the sides 96 are separated, and an opening 102 is defined at a leading cut edge 104 of the film 212.

Operational details and additional structure elements of exemplary sealing system 50 will be expanded upon below.

Methodology

Figure 15:
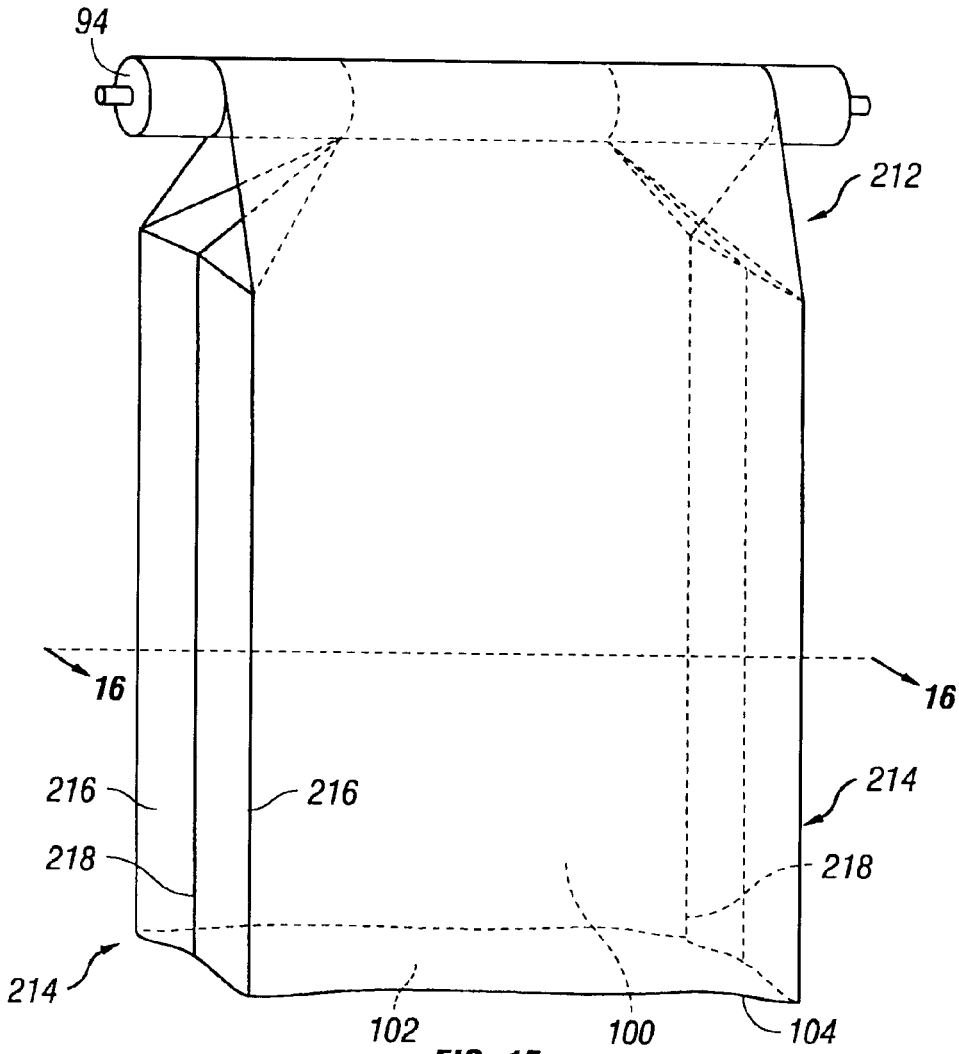
FIG. 15 is a perspective view of pleated film utilized by the sealing systems of the present invention.
Figure 16:
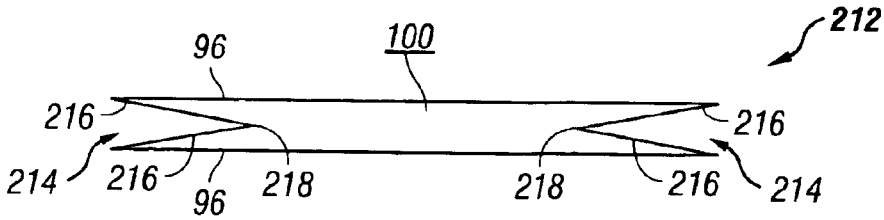
FIG. 16 is a cross-sectional view of pleated film taken along line 16—16 of FIG. 15.
Figure 17:
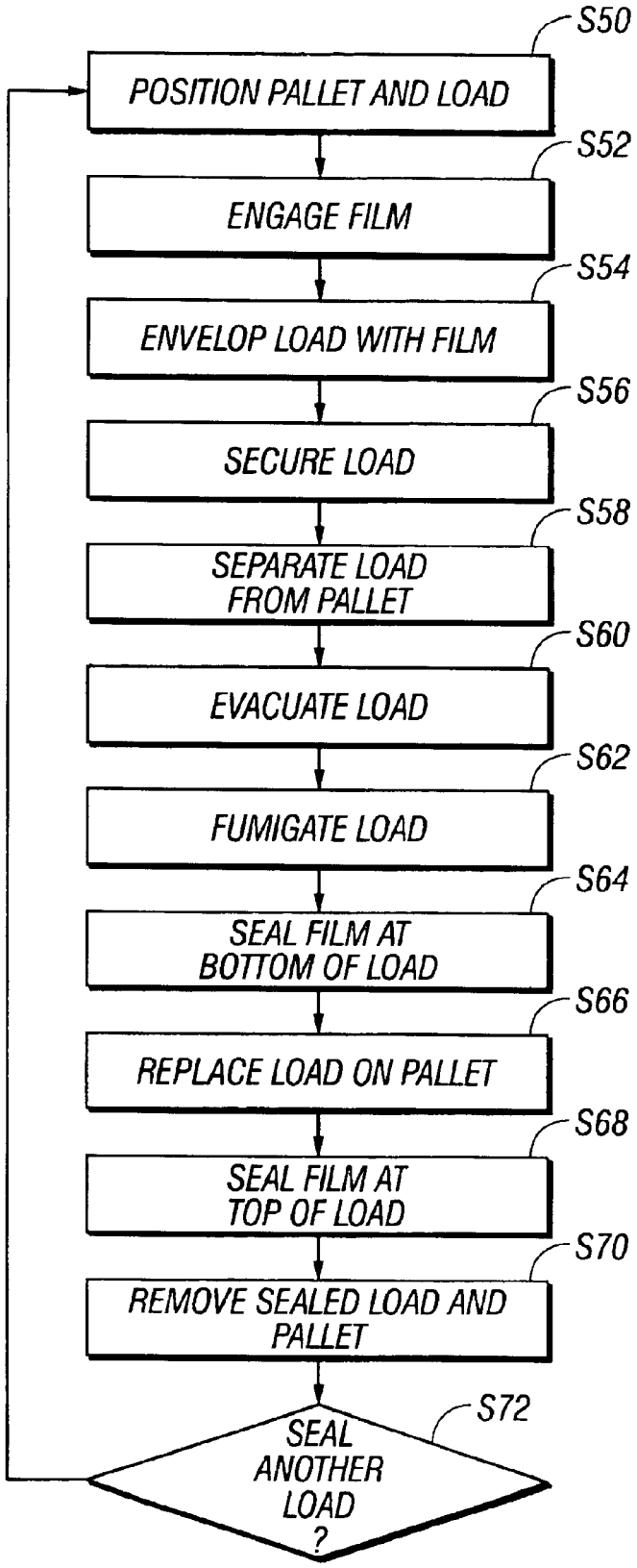
FIG. 17 is a flowchart illustrating preferred methodology for sealing a load placed on a pallet in accordance with the present invention.

With the foregoing description focussing on the apparatus of the invention, methodology of the invention will now follow utilizing the pleated film 212 shown in FIG. 15 and 16 and referencing FIGS. 17, 18, and 19.

Figures 19A, 19B, 19C:
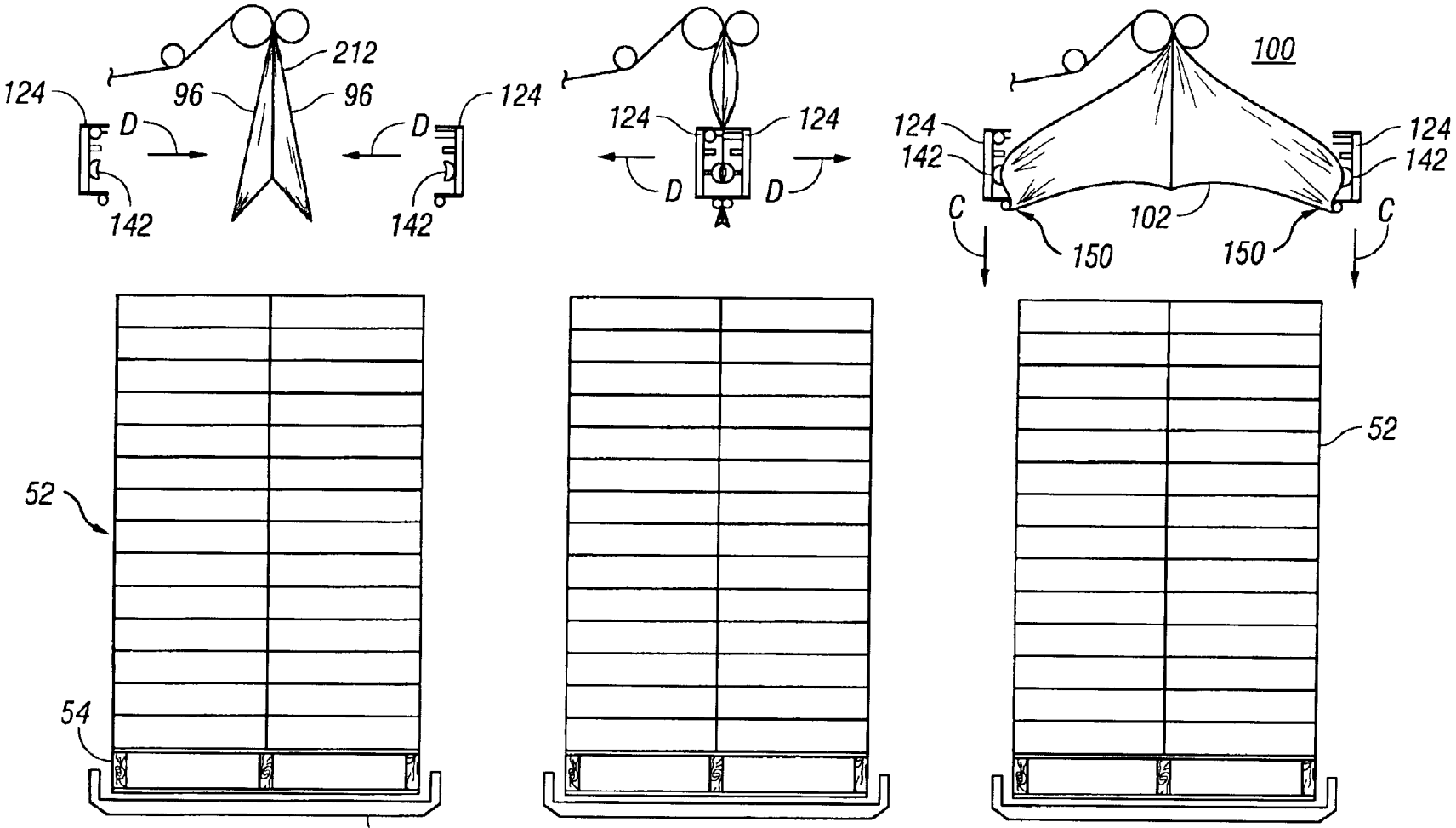
FIGS. 19A through 19J are front plan view of a load, film, and a pallet, with each figure respectively illustrating a successive step in exemplary methodology of the invention.

As mentioned above, exemplary sealing system 50 seals a load 52 placed or positioned on a pallet 54, with the sealed load then being ready to be prepared for shipping or storage. In operation, the pallet 54 with the load 52 is initially positioned on the platform 76 (step S50), as shown in FIG. 17A. The film 92 may then be engaged (step S52) with the vacuum subsystem 140. As described briefly above, to engage the film 92, the cross members 124 close as indicated by Step 1 in the table of FIG. 15 and as shown by arrow D in FIG. 19A, at which time the vacuum subsystem 140 is ON so that negative pressure, or vacuum, is created at the vacuum ports 142. When the cross members 124 have closed a sufficient distance, the sides 96 of the film 212 are engaged and retained by the vacuum ports 142 as shown in FIG. 19B. The load 52 may now be enveloped with the film 212 (step S54).

To do so, the cross members 124 may be opened as indicated by arrows D in FIG. 19B and Step 2 in the table of FIG. 18. The outward movement of the cross members 124 separates the sides 96 of the film 212 and enlarges the opening 102, thereby defining the inner space 100 of the film 212 as shown in FIG. 19C. When the cross members 124 have moved outwardly to a position beyond the width (and/or the depth) of the load 52, the rack propulsion subsystem 180 may then be actuated to lower the rack 106 and, accordingly, the cross members 124 and the film 212 downwardly over the load 52 as shown by arrows C in FIG. 19C and indicated by Step 3 in FIG. 18.

Figure 20B:
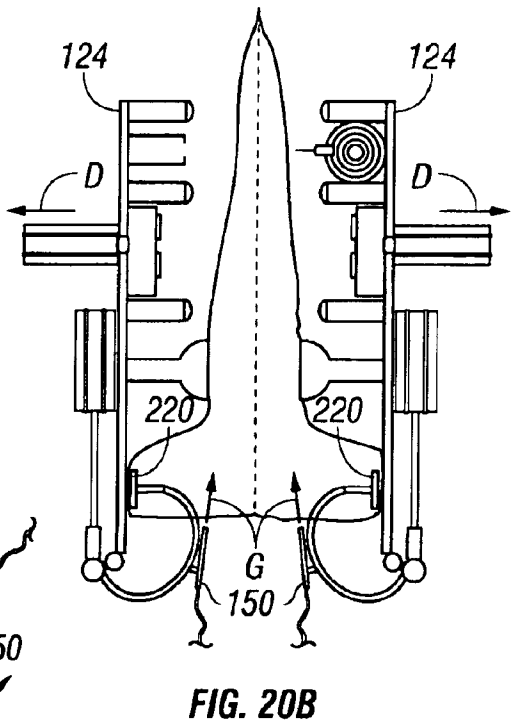
FIGS. 20A and 20B are fragmentary side plan views of a sealing subsystem including vacuum and injection subsystems of the invention, particularly illustrating the subsystems in relation to film for sealing a load.
Figure 20A:
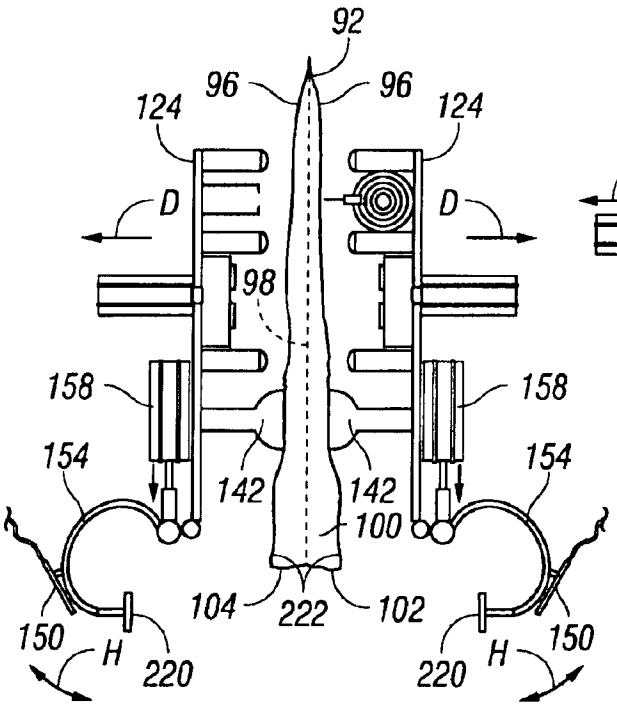

To further define and to enlarge the inner space 100, the injection subsystem 148 may be activated to inject air through the opening 102 of the film 212 either prior to and/or during the decent of the cross members 124. For example, as shown in the exemplary embodiment of pivotal injections nozzles 150 mentioned above and shown in FIGS. 8 and 20A, cylinders 158 may be activated to pivot the nozzles 150 inwardly as shown by arrows H in FIG. 20A. Resulting from the rotation, a pad 220 mounted on each linkage 154 contacts an inside surface 222 of a respective one of the sides 96 of the film 92 (or 212) and presses the side 96 against a respective one of the cross members 124, as shown in FIG. 20B. In turn, the nozzles 150 may be activated to inject air upwardly through the opening 102 to expand the film 92 and enlarge the inner space 100 as shown by arrows G. Both of these preferred functions of the invention are indicated in Step 2 of the table in FIG. 18, with the position of the injection nozzles IN and the air (e.g., from the compressor 70) ON.

Figures 19D, 19E, 19F:
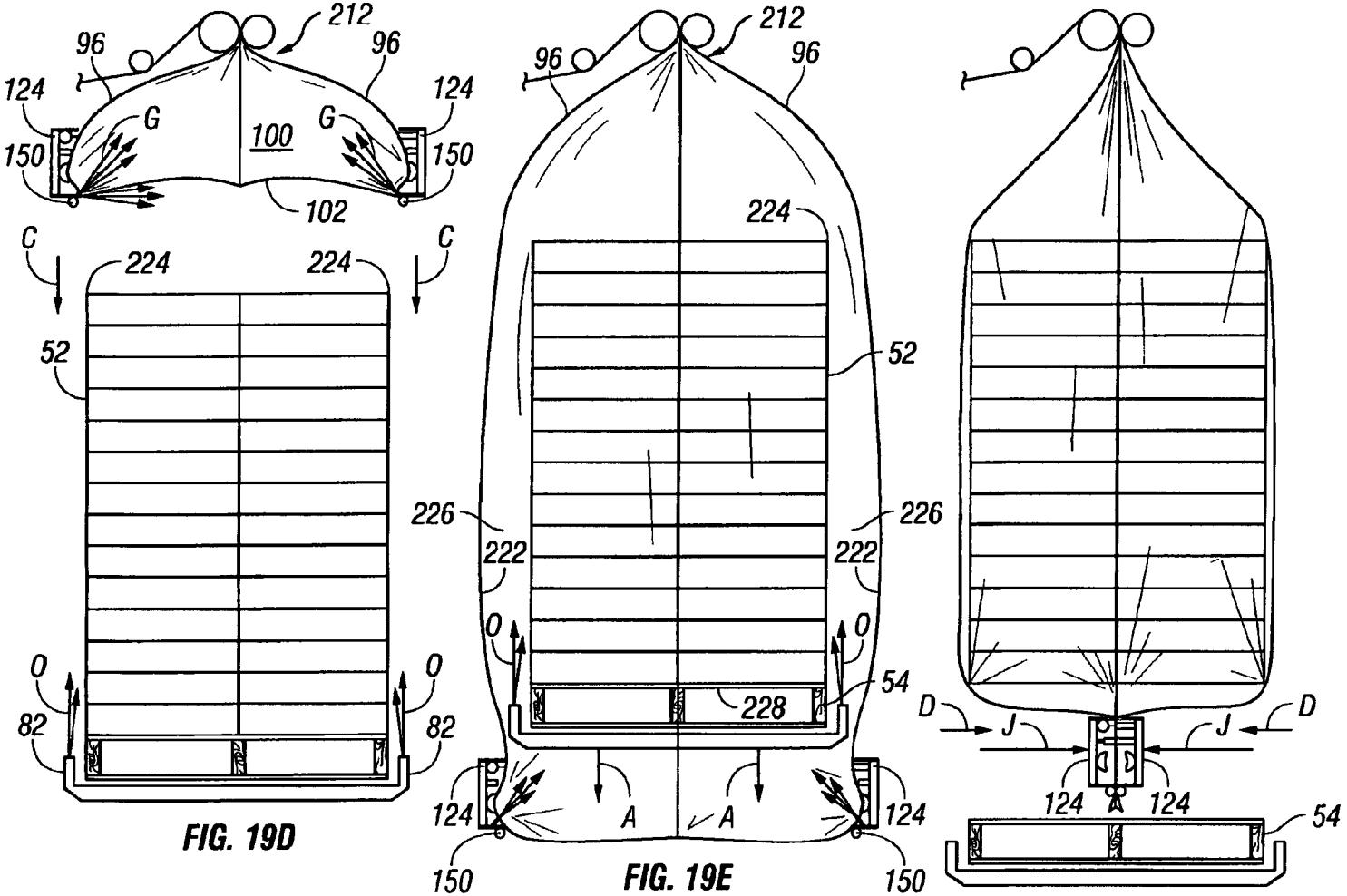

An alternative embodiment for enhancing the separation of the sides 96 and the definition of the inner space 100 of the film 212 is shown in FIG. 19D. In this embodiment, the injection nozzles 150 as disposed on the cross members 124 in a nonrotatable manner but with the nozzles 150 directed upwardly and inwardly. Accordingly, when activated, the nozzles 150 inject air upwardly through the opening 102 as shown by arrows G to expand the film 212 and enlarge the inner space 100. Accordingly, as the rack 106 (not shown) and the cross members 124 lower as shown by arrows C, thereby drawing additional film 212 from the roll 94 (see FIGS. 1 and 15), the air from the injection nozzles 150 continuously expands the film 212 to prevent the sides 96 of the film 96 from catching or snagging on the load 52, particularly at a top 224 thereof.

To further enhance this anti-snagging feature of the invention, the platform nozzles 82 may be activated to inject air upwardly as shown by arrows O. Accordingly, a barrier of positive pressurize air is defined between the load 52 and the inside surface 222 of the sides 96 of the film 212 as the cross members 124 descend, which positive air barrier is indicated by reference numeral 226 in FIG. 19E.

When the rack 106 has reached a lower position, for example, when the cross members 124 are at a vertical position below a bottom 228 of the load 52 as shown in FIG. 19E, then the load 52 may be secured (step S56), preferably independently of the pallet 54. To do so, the clamping subsystem 84 may be activated to press the load 52 between the plates 86 as discussed above (Step 4). The injection nozzles 150 may be turned OFF at this time if desired. Once secured, the load 52 is separated from the pallet 54 (step S58) by, for example, lowering the platform 76 with the substructure 78 (Step 5) as shown by arrows A in FIG. 19E; accordingly, the pallet 54 is lowered away from the load 52 as shown in FIG. 19F. Alternatively, the clamping subsystem 84 may be configured to lift the load 52 upwardly from and off the pallet 54.

In certain implementations, it may be desired to configured the injection nozzles 150 in communication with the vacuum source 144 so that the injection nozzles 150 may be activated to evacuate the load 52 within the film 212 (step S60), thereby drawing the film 92 against the load 52. After a predetermined amount of time (e.g., 20 seconds), the vacuum at the nozzles 150 may be turned OFF (Step 6.1).

In applications of the principles of the invention involving produce, it may be preferable to fumigate the load 52 with a gas. More specifically, gas from the gas supply 152 may be provided to the injection nozzles 150 to fumigate the load 52 (step S62 and Step 6.2). After a predetermined amount of time, the nozzles 150 may be turned OFF (Step 6.3) and, if configured according to the embodiment shown in FIG. 8, rotated outwardly (Step 6.4) on the linkages 154. In addition to the injection nozzles 150, the platform nozzles 82 may also be connected to the gas supply 152 and/or the vacuum source 144.

Once the pallet 54 is separated from the load 52 and once any optional evacuation and/or fumigation of the load 52 is completed, the film 212 may be sealed at the bottom 228 of the load 52 (step S64 and Step 6.5). To do so, the cross members 124 may be moved inwardly (Step 6) as shown by arrows D in FIG. 19F and brought together, thereby clamping the film 212 therebetween.

Figure 21:
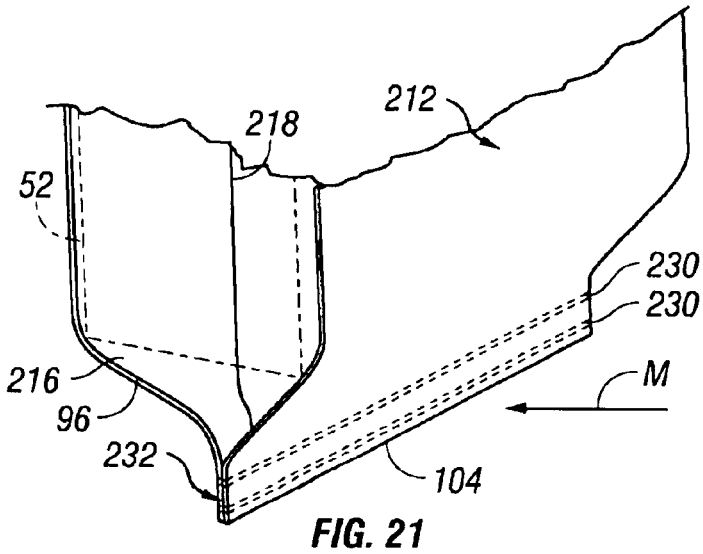
FIG. 21 is a fragmentary perspective view of film enveloping a load in accordance with the invention, particularly illustrating a seal formed in the film at a bottom of the load.

As described above, cylinders 178 may then be activated to drive the heat impulse bars 174 together as shown by arrows J in FIG. 19F, and the heat impulse bars 174 may be activated to melt the sides 96 of the film together 92. As shown in FIG. 21, by heating and melting the sides 96 of the film 212 together between the heat impulse bars 174, one or more seals 230 are formed at or near the leading cut edge 104 of the film 212.

Figure 22:
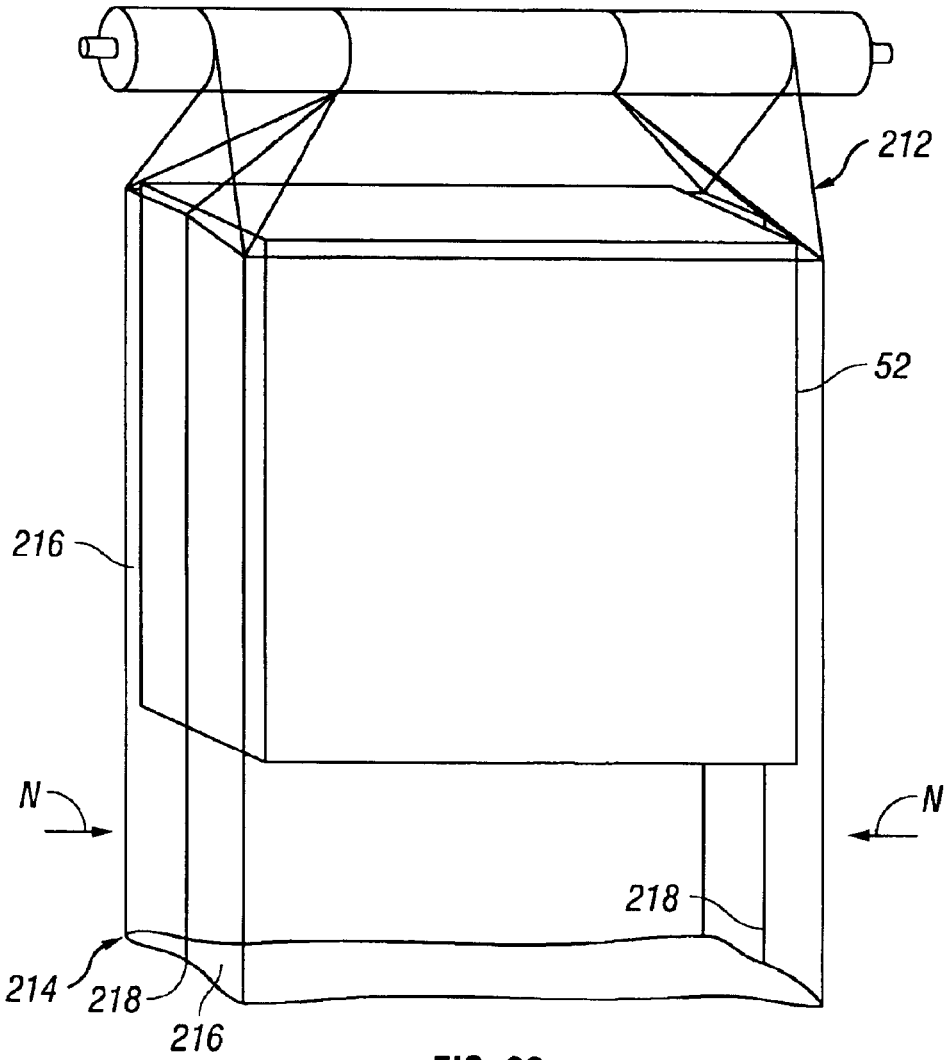
FIG. 22 is a perspective view of pleated film enveloping a load in accordance with the invention.
Figure 23:
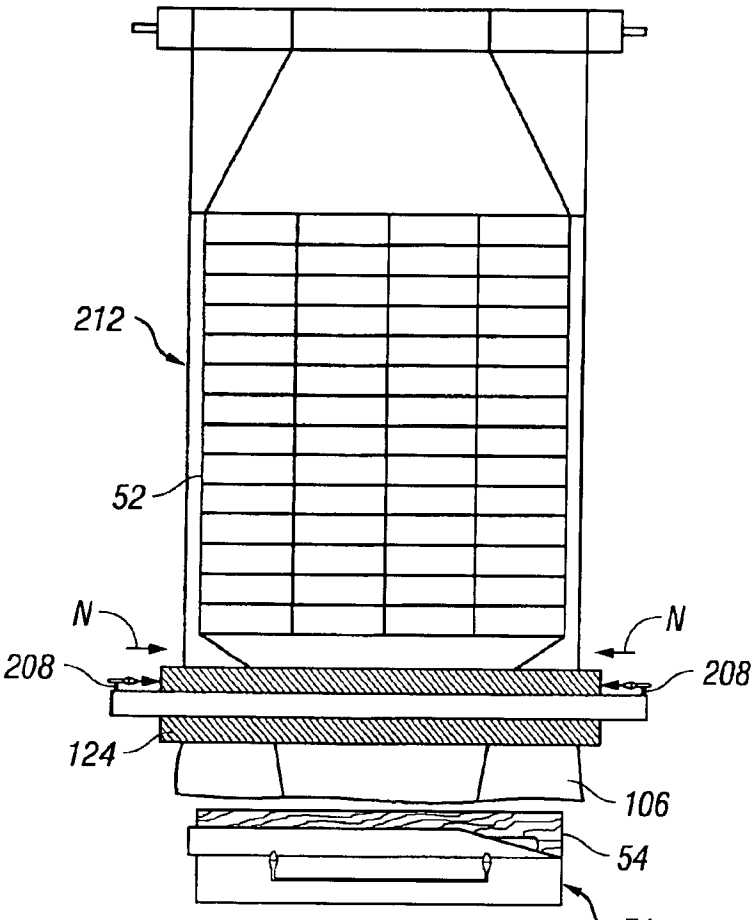
FIG. 23 is a side plan view of a load being sealed within film according to the invention, particularly when the load is separated from a pallet.

The formation of the seal 230 may be enhanced by utilizing the side air nozzles 208. More specifically, as shown in Step 6 of FIG. 18, when the cross members 124 close, the side air nozzles 208 may be actuated to inject air toward the pleat 214 of the film 212 (see FIGS. 14 and 15) as shown by arrows N in FIGS. 22 and 23, thereby urging the crease 218 inwardly. The inward movement of the crease 218, in turn, causes the panels 216 to neatly fold and substantially align when the heat seal bars 174 are brought together to form the seal(s) 230, thereby forming a flap 232 without substantial buckling of the film 212 as shown in FIG. 21.

Figures 19G, 19H, 19I:
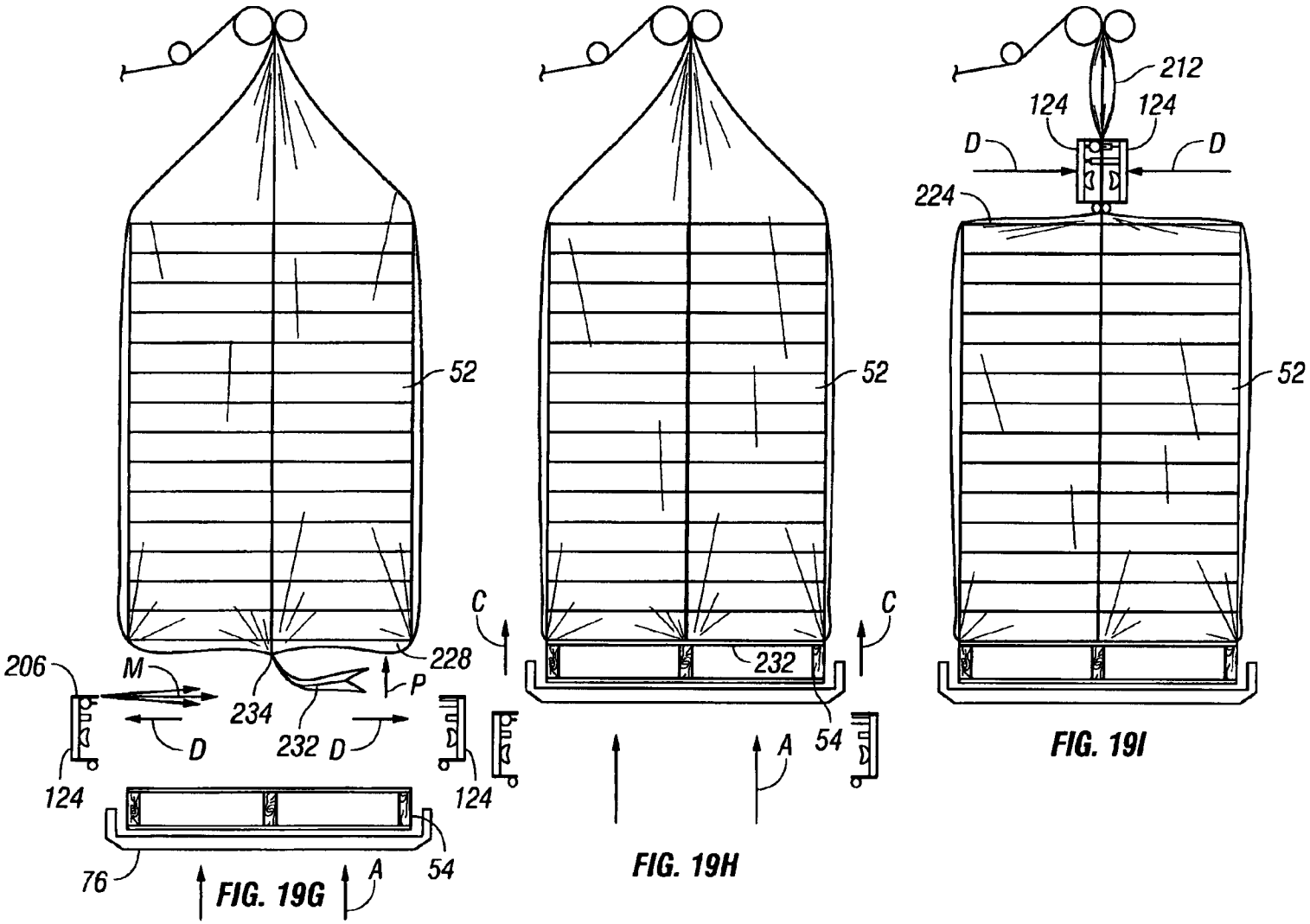

After a predetermined amount of time sufficient to form an adequate seal 230, the cross members 124 may open (Step 7) as shown by arrows D in FIG. 19G, and the load 52 may be replaced on the pallet 54 (step S66). According to the preferred embodiment shown in the drawings, this step may be carried out by raising the platform 76 (Step 8) until the load 52 rests thereon.

Figure 24:
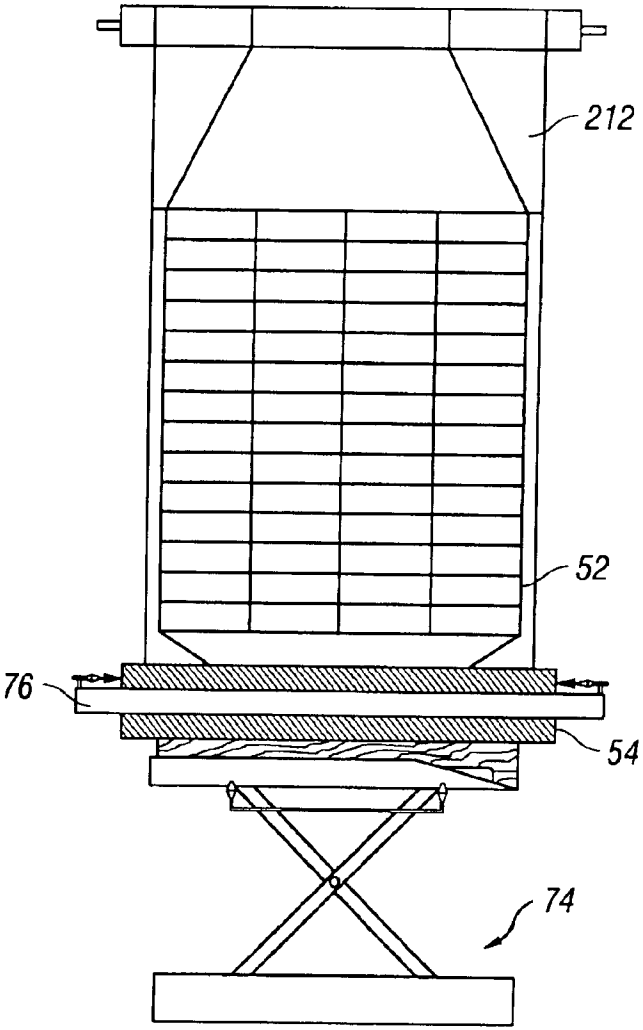
FIG. 24 is a side plan view of a sealed load positioned on a pallet in accordance with the invention.
Figure 25:
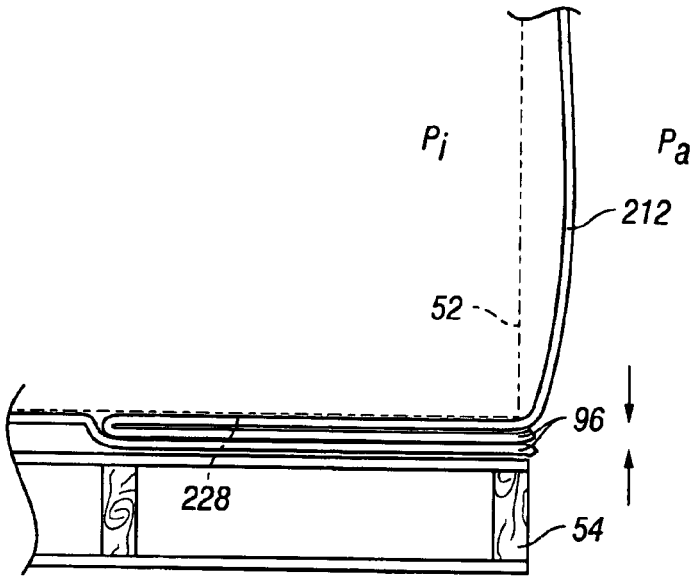
FIG. 25 is a enlarged fragmentary cross-sectional view of a flap sandwiched between a bottom of a sealed load and a pallet in accordance with an exemplary embodiment of the invention.

To enhance the placement of the load 52 on the pallet 54, the flap 232 may be folded over to one side or the other as shown in FIG. 19G. For example, the center air nozzle 206 may be activated as shown in Steps 7 and 8 in FIG. 18 to blow air inwardly toward the flap 232 as shown by arrow M in FIG. 19G, thereby urging the flap 232 to fold upwardly as shown by arrow P. The platform 76 may then be raised as shown by arrow A, with the flap 232 neatly folded over and positioned between the pallet 54 and the bottom 228 of the load 52 as shown in FIGS. 19H, 24, and 25. In other words, the flap 232 is preferably sandwiched in a planar relationship between the bottom 228 of the load 52 and the pallet 54. Accordingly, the load 52 rests with more stability than may be possible otherwise.

Figure 26A:
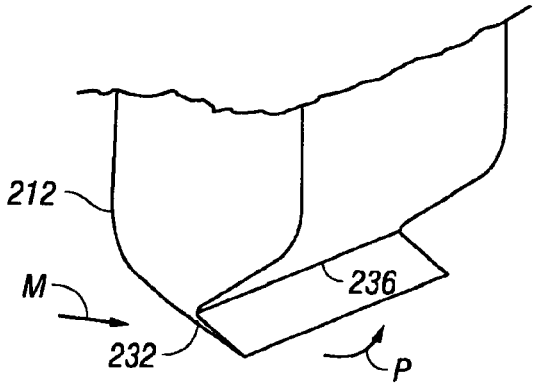
FIGS. 26A and 26B are fragmentary perspective views of an enveloped load where a seal is formed by folding a flap over to one side to be compressed between the load and a pallet.
Figure 26B:
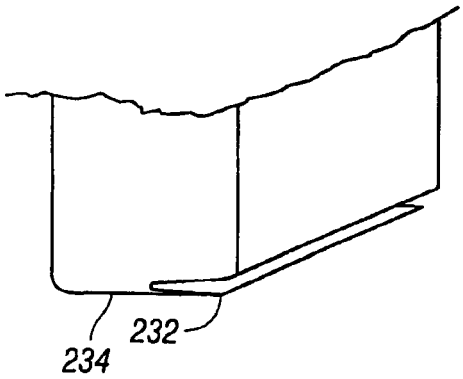

In an alternative embodiment shown in FIGS. 26A and 26B, a seal may be formed without utilizing the heat impulse bars 174. More specifically, by folding of the flap 232 and positioning the flap 232 between the pallet 54 and the bottom 228 of the load 52, a seal 234 along a fold line 236 of the flap. When the load 52 is replaced on the pallet 54, the weight of the load 52 presses the sides 96 of the film 212 together, particularly along the fold line 236, to maintain the seal 234.

The pallet 54 on which the load 52 is positioned after the seal is formed may be the same pallet on which the load 52 was originally positioned within the frame 58 or may be another pallet as desired by the user. More specifically, in certain embodiments, it may be preferable to replace the originally used pallet 54 (e.g., as shown in FIG. 19A) with another pallet 54, either of different dimensions or made of different material.

Once replaced on a pallet, the load 52 may be released by the clamping subsystem 84 (Step 9), and the rack 106 and, accordingly, the cross members 124 may be raised as shown by arrows C in FIG. 19H. The rack 106 may be raised to an upper position, for example, where the cross members 124 are at a vertical position above the top 224 of the load 52 (Step 10) as shown in FIG. 19I.

Figure 27A:
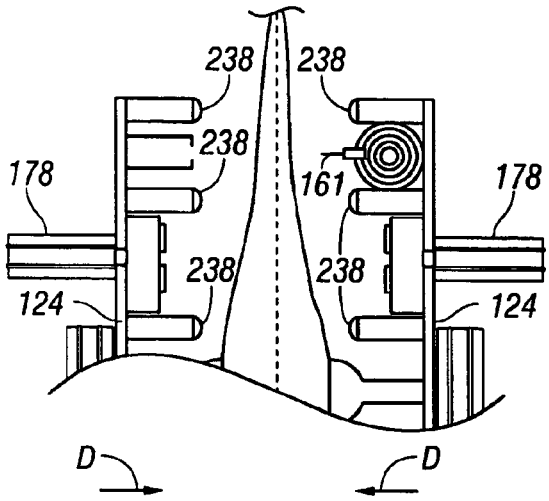
FIGS. 27A, 27B, and 27C are fragmentary side plan views of a sealing subsystem including cutting and heat-sealing subsystems of the invention, particularly illustrating the subsystems in relation to film at a top of a load.
Figure 27B:
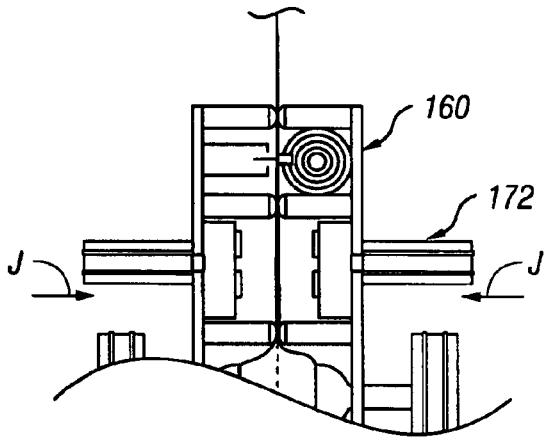

The film 212 may now be cut and sealed at the top 224 of the load 52 (step S68). To carry out this operation, the cross members 124 may be moved inwardly as shown by arrows D in FIG. 19I and 27A and closed (Step 11) as shown in FIGS. 191 and 27B. Analogous the description above, the side air nozzles 208 may again be actuated to enhance the formation of the pleat 214 in the film 212 at the top 224 of the load 52. As shown FIG. 27, the cross members 124 may include one or more bumpers 238 disposed at various longitudinal locations thereof. The bumpers 238 are configured so that the film 212 is pressed between opposing pairs of bumpers 238 and held in place, as particularly shown in FIG. 27B.

When in this position, the cutting subsystem 160 may be activated to cut the film 212 with the knife 161. For example, the knife 161 may pierce the film 212 as shown in FIG. 19I and 27B, and the pneumatic source 168 (see FIG. 10) may be actuated to urge the knife 161 transversely through the film 212. Thereafter, the sealing subsystem 172 may be activated to form a seal in the film 212 analogous to that described above (Step 11.1).

Figure 19J:
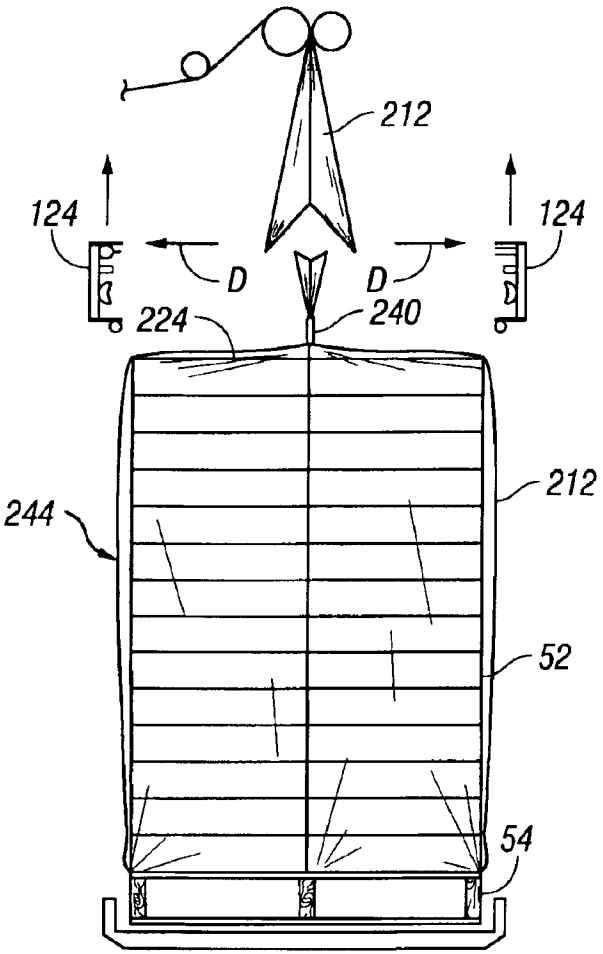
Figure 27C:
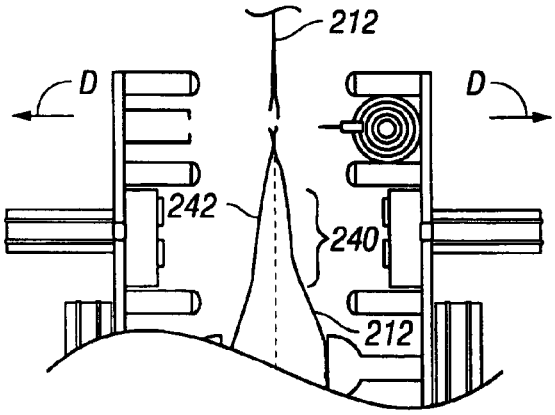

When the film 212 has been cut and sealed at the top 224 of the load 52, the cross members 124 may be moved outwardly as shown by arrows D in FIG. 27C (Step 12). A seal (which is indicated by reference numeral 240) is, accordingly, formed in the film 212 at or near a trailing cut edge 242 of the film 212. The rack 106 may now be raised (Step 13) to an original starting position above the load 52 as shown by arrow C in FIG. 19J, and the load 52, now sealed, may be removed from the frame 58 on the pallet 54 (step S70). If desired, another load placed on a pallet may be positioned on the platform 76, and the process repeated (step S70 and Step 14). As shown in FIG. 19J, when a load 52 is sealed on a pallet 54 in accordance with the methodology of the invention, the film 212 (or 92) forms a bag 244 around the load 52, with a seal 230 or 234 formed under the bottom 228 of the load and a seal 240 formed over the top 224 of the load.

Referencing FIG. 25, in implementing of the principles of the present invention in the context of preservation of produce, it may be preferable to seal the load 52 such that a preferred artificial environment is create within the sealed film 212. For example, if the load 52 comprises strawberries packed in cartons 56, then during the fumigation step (step S62), nitrogen may be ejected from the injection nozzles 150 (and/or the platform nozzles 82). When the film 212 is sealed, an internal pressure $P_i$ within the film 212 is created. According to a preferred produce embodiment, the internal pressure $P_i$ is greater than an ambient pressure $P_a$ outside of the film 212. The artificial atmosphere and the pressure difference retards the ripening of the produce packed within the cartons 56 by minimizing the amount of oxygen within the film 212 and inhibiting any respiration of oxygen through the film 212.

Those skilled in the art will understand that the preceding exemplary embodiments of the present invention provide the foundation for numerous alternatives and modifications thereto. These other modifications are also within the scope of the present invention. Thus, by way of example, but not of limitation, the frame 58 of the present invention may be configured to be portable so that, for example, a forklift can load and move the system 50 relatively easily, thereby increasing the functionality of the system. In addition, the load does not need to be placed on a pallet but may be set directly on the platform. Accordingly, the present invention is not limited to that precisely as shown and described in the present invention.

What is claimed is:

1. A method for sealing a load placed on a pallet, the load having a top end and a bottom end, the bottom end placed on the pallet, the method comprising:

enveloping the load within film;

securing the load independently of the pallet;

separating the load from the pallet; and sealing the film over the bottom end of the load.

2. A method as claimed in claim 1 further comprising:

evacuating the load when the load is enveloped within the film.

3. A method as claimed in claim 1 further comprising:

fumigating the load when the load is enveloped within the film.

4. A method as claimed in claim 1 further comprising:

injecting a gas within the film when the load is enveloped within the film.

5. A method as claimed in claim 1 further comprising:

replacing the load on the pallet.

6. A method as claimed in claim 1 further comprising:

placing the pallet with the load on a platform.

7. A method as claimed in claim 1 further comprising:

sealing the film over the other end of the load.

8. A method as claimed in claim 1 further comprising:

cutting the film near the other end of the load.

9. A method for sealing a load placed on a pallet with film, the load having a top and a bottom, the film being in the form of a sleeve having an opening, the method comprising:

(a) placing the pallet with the load on a platform;

(b) enveloping the load within the film;

(c) securing the load independently of the pallet;

(d) separating the load from the pallet;

(e) sealing the opening of the film under the bottom of the load; and (f) placing the load on a pallet;

wherein step (d) takes place prior to step (e).

10. A method as claimed in claim 9 further comprising:

purging the load when the load is within the film.

11. A method as claimed in claim 9 further comprising:

injecting a gas within the film when the load is within the film.

12. A method as claimed in claim 9 wherein step (f) comprises:

placing the toad on a pallet that is different from the pallet placed on the platform in step (a).

13. A method as claimed in claim 9 further comprising:

removing the pallet from the platform when separated from the load; and placing another pallet on the platform.

14. A method for sealing a load placed on a pallet, the load having a top end and a bottom end, the bottom end placed on the pallet, the method comprising:

enveloping the load within film;

securing the load independently of the pallet;

separating the load from the pallet; and enveloping the bottom end of the load with the film.

15. A method as claimed in claim 14 further comprising:

sealing the film over the bottom end of the load.

16. A method as claimed in claim 15 further comprising:

sealing the film over the top end of the load.

17. A method as claimed in claim 16 further comprising:

cutting the film near the other end of the load.

18. A method as claimed in claim 14 further comprising:

evacuating the load when the load is enveloped within the film.

19. A method as claimed in claim 14 further comprising:

fumigating the load when the load is enveloped within the film.

20. A method as claimed in claim 14 further comprising:

injecting a gas within the film when the load is enveloped within the film.

21. A method as claimed in claim 14 further comprising:

replacing the load on the pallet.

22. A method as claimed in claim 14 further comprising:

placing the pallet with the load on a platform.

23. A method for sealing a load placed on a pallet with film, the load having a top and a bottom, the film being in the form of a sleeve having an opening, the method comprising:

placing the pallet with the load on a platform;

enveloping the load within the film;

securing the load independently of the pallet;

separating the load from the pallet;

enveloping at least the bottom of the load with the film; and placing the load on a pallet.

24. A method as claimed in claim 23 further comprising:

sealing the opening of the film under the bottom of the load prior to placing the load on the pallet.

* * * * *